US008225578B2

(12) United States Patent
Azizi Ronagh

(10) Patent No.: US 8,225,578 B2
(45) Date of Patent: Jul. 24, 2012

(54) FLEXIBLE INTERLOCKING MORTARLESS WALL UNIT AND CONSTRUCTION METHOD

(76) Inventor: Mohammad Reza Azizi Ronagh, Shiraz (IR)

( * ) Notice: Subject to any disclaimer, the term of this patent is extended or adjusted under 35 U.S.C. 154(b) by 0 days.

(21) Appl. No.: 12/684,972

(22) Filed: Jan. 11, 2010

(65) Prior Publication Data

US 2011/0167749 A1 Jul. 14, 2011

(51) Int. Cl.
*E04B 1/04* (2006.01)
*E04B 1/00* (2006.01)
*E04B 1/38* (2006.01)

(52) U.S. Cl. ..... 52/747.1; 52/745.06; 52/592.5; 52/571; 52/285.2

(58) Field of Classification Search ..... 52/592.5, 52/592.6, 603, 606, 566, 571, 503, 582.1, 52/583.1, 285.2, 414, 747.1, 745.06, 23, 52/604

See application file for complete search history.

(56) References Cited

U.S. PATENT DOCUMENTS 2,184,714 A * 12/1939 Freeman ..... 52/250
2,627,176 A * 2/1953 Levy ..... 52/223.7
2,815,656 A * 12/1957 Klein et al. ..... 52/169.1
4,688,362 A * 8/1987 Pedersen et al. ..... 52/223.7
4,726,567 A * 2/1988 Greenberg ..... 256/19
5,007,218 A * 4/1991 Bengtson et al. ..... 52/204.2
5,138,808 A * 8/1992 Bengtson et al. ..... 52/204.2
5,355,647 A * 10/1994 Johnson et al. ..... 52/503
5,678,373 A * 10/1997 Franklin et al. ..... 52/439
5,782,048 A * 7/1998 Ramirez ..... 52/295
5,899,040 A * 5/1999 Cerrato ..... 52/604
5,924,254 A * 7/1999 Franklin et al. ..... 52/439
6,076,319 A * 6/2000 Hendershot et al. ..... 52/271
6,088,987 A * 7/2000 Simmons et al. ..... 52/592.6
6,098,357 A * 8/2000 Franklin et al. ..... 52/223.7
6,151,842 A * 11/2000 Hododi ..... 52/79.8
6,178,714 B1 * 1/2001 Carney, Jr. ..... 52/564
6,244,009 B1 * 6/2001 Cerrato ..... 52/604
6,758,020 B2 * 7/2004 Cerrato ..... 52/606
6,883,281 B1 * 4/2005 Chavez-Gandara ..... 52/284
7,387,472 B2 * 6/2008 Abella ..... 405/284
7,546,712 B2 * 6/2009 Shaw ..... 52/223.8
7,568,321 B2 * 8/2009 Morey et al. ..... 52/747.1
7,934,351 B2 * 5/2011 Clarno ..... 52/741.13
7,946,086 B2 * 5/2011 Hammer et al. ..... 52/223.5
2002/0007610 A1 * 1/2002 Ali et al. ..... 52/604
2002/0043038 A1 * 4/2002 Cerrato ..... 52/604
2003/0009963 A1 * 1/2003 Crowell ..... 52/270
2004/0020145 A1 * 2/2004 Matsufuji ..... 52/223.7
2006/0005500 A1 * 1/2006 Hovnanian ..... 52/592.6
2007/0245673 A1 * 10/2007 Cerrato ..... 52/607

(Continued)

*Primary Examiner* — Brian Glessner
*Assistant Examiner* — Rodney Mintz
(74) *Attorney, Agent, or Firm* — Barry Choobin; Choobin & Choobin Consultancy LLC

(57) ABSTRACT

The various embodiments of the present invention provide a slab roof for interlocked mortarless masonry wall systems. In a method of providing a mortarless construction system, a wall foundation including foundation tendon rods is constructed and a first set of mechanical fastening is attached to the foundation tendon rods. A first set of tendon rods is attached to the first set of mechanical fastening. A wall structure is created by vertically stacking a plurality of wall units onto the threaded tendon rods and affixing the wall units using the mechanical fastening. A plurality of roof connecters is attached to the threaded tendon rods of the wall structure and a plurality of roof rods are attached to the roof connecters of opponent walls horizontally to form a network of roof rods which are interconnecting the walls for building a roof.

7 Claims, 26 Drawing Sheets

U.S. PATENT DOCUMENTS

2007/0251182 A1* 11/2007 Van Steinburg ..... 52/586.1
2008/0098687 A1* 5/2008 Marsh et al. ..... 52/606
2009/0094916 A1* 4/2009 Crumley ..... 52/293.3
2009/0313923 A1* 12/2009 Bucheger ..... 52/223.7
2010/0162650 A1* 7/2010 Van Steinburg ..... 52/568
2010/0325998 A1* 12/2010 Clear ..... 52/503

* cited by examiner

FLEXIBLE INTERLOCKING MORTARLESS WALL UNIT AND CONSTRUCTION METHOD

BACKGROUND

1. Technical field

The embodiments herein generally relates to construction systems and methods of walls and roofs. The embodiments herein particularly relates to mortarless construction of walls and roofs. The embodiments herein more particularly relates to a mortar less construction of buildings using a combination of precast structural units and cast in situ techniques.

2. Description of the Related Art

The human ingenuity has evolved at numerous sophisticated methods and materials to meet the need of shelter. The traditional masonry structures which use mortar require several things like water, power and skilled mason. The power is required to prepare the mortar mixture and the skilled mason is needed for laying of blocks. Further elaborate bracing and reinforcement are needed in the construction until the mortar cures and reaches substantial strength. During the curing time, the overall structure is fragile to wind, temperature and other environmental conditions.

If proper preparation and care are not provided to reduce the environmental impacts, the mortar and the overall structure may result in cracking and diminished structural strength. Reinforcing means are often provided to improve the strength, but the need to have bracing and other protection in place for many days and even weeks is still needed. Further the traditional masonry structures which use mortar often have straight sections which are staggered and have wire mesh and an occasional rebar for providing the support. Upon completion of the construction, the traditional masonry systems become a fixed structure. Unless very special and complex features are added to the normal block, the rebar and the mortar system, the structure is essentially not re-useable and must be demolished for removal of the structure.

Many methods of construction use precast concrete units that are assembled to create a building structure. These methods include construction systems incorporating a wide range of precast concrete units varying from simple designs to complex designs. The most simple precast concrete unit designs are used in basic concrete masonry. While concrete masonry units are easy to design, the concrete masonry units can be considered structurally inferior to the precast concrete units which are created with larger and reinforced structure. Smaller concrete masonry units can crack and chip as well. Working with small concrete masonry units also requires a specialized labor force to implement the construction. As a result, using such a building method creates high labor costs and it is difficult to find a qualified crew.

The pre-manufactured building components for structural-load-bearing panels must, however, comply with a number of specifications based on the structural criteria such as axial load-bearing, shear and racking strengths and total weight of the components. Additional criteria that may affect the specification of the components include fire resistance, thermal insulation efficiency, sound abating properties, rot and insect resistance and water resistance. The types of pre-manufactured building components that is designed, assembled and shipped to meet all of these specifications are narrowly defined, highly specific and tolerated compared to the traditional component constructions. The resultant high quality preferred pre-manufactured building component is readily transportable, efficiently packaged and easily handled for the construction site.

Currently there are many methods available for the construction of mortarless masonry structures. According to a conventional method, a single connecting rod is used, which traverses through the centre of the pre-manufactured blocks to connecting all masonry blocks of the wall and securing the blocks together with one bolt on the top. However, such structures exhibits less strength and are less resistant to earth quakes and other environmental hazards. Another method uses metal sheets and the metal pipes for constructing the masonry structures which increases the weight of the building and provides poor strength to the building.

The conventional methods of construction do not explain the formation of the roofs, windows and doors in the masonry structures. Further the existing building systems have not been developed to provide versatility in design, accommodation for a variety of reinforcement designs and anti-earthquake characteristics. The existing building systems require relatively huge lifting equipments which in turn increase the period of construction of buildings. Also in many systems, the roof does not have any secure connection to the walls.

The abovementioned shortcomings, disadvantages and problems are addressed herein and which will be understood by reading and studying the following specification.

SUMMARY

The primary object of the embodiments herein is to provide a system and method for mortarless construction using a combination of preformed structures and cast in situ component which accommodates a wide range of reinforcement designs to construct a variety of building shapes.

Another object of the embodiments herein is to provide a mortarless block construction adapted for self supporting floor or roof constructions using light weight and load bearing characteristic masonry blocks.

Yet another object of the embodiments herein is to provide a building block formed of relatively light weight Ultra High Performance Concrete (UHPC) material which is combined with reinforcing material to produce a resultant comparatively monolithic structure.

Yet another object of the embodiments herein is to build a mortarless earthquake resistance construction.

Yet another object of the embodiments herein is to develop a slab roof for interlocked mortarless wall systems.

Yet another object of the embodiments herein is to provide preformed building blocks which are easily assembled and disassembled for use in construction of wall structures.

These and other objects and advantages of the present invention will become readily apparent from the following detailed description taken in conjunction with the accompanying drawings.

The various embodiments of the present invention provide a system and method for a mortarless construction system with a slab roof using a combination of precast masonry wall units and reinforcing elements. According to one embodiment, a wall unit for use in a mortarless construction includes a masonry solid block having a top surface, an interlocking element provided on the top surface, a bottom surface including a groove, at least one cavity extending vertically along the interior of the block from the interlocking element to the bottom surface, a first side surface having a locking member and a second side surface having a locking slot wherein the first side surface and the second side surface are disposed opposite of each other. The groove provided on the bottom surface is adapted to engage with the interlocking element on the top surface of the underlying block. The interlocking element is shaped conical. The locking member herein is a protrusion extending along the length of the first side surface. The locking slot is a channel adapted to receive the locking member of the adjacent horizontally staggered wall unit to provide an abutting relation with each other. The block is formed of an Ultra High Performance Concrete (UHPC) material of high tensile strength.

Another embodiment herein includes wall unit retaining elements including a longitudinal tendon rod having at least one threaded end section and a mechanical fastening means. The length of the tendon rod is selected such that at least one threaded end section of the tendon rod projects out of the block to receive the mechanical fastening means. Here, a plurality of blocks is vertically stacked using the wall retaining means to define a wall structure. The mechanical fastening means includes at least one of a nut, a spring washer and a washer.

According to one embodiment of the present invention, a method of providing a mortarless construction system includes building a wall foundation including a plurality of foundation tendon rods which are having a threaded end section projecting above a surface of the wall foundation, providing a first set of mechanical fastener to each threaded end section of the plurality of foundation tendon rods projecting out of the wall foundation, attaching a first set of threaded tendon rods to the first set of mechanical fastening and arranging a plurality of wall units in a horizontal row on the first set of threaded tendon rods in such a way that the first set of threaded tendon rods pass through the plurality of wall units and each threaded end portion of the first set of threaded tendon rods is projected out of the top surface of the plurality of wall units.

The method further includes providing a second set of mechanical fastening means to each threaded end portion of the first set of threaded tendon rods passed through the channel of the plurality of wall units to fasten the plurality of wall units to the wall foundation, creating a wall structure by vertically stacking the plurality of wall units onto the threaded tendon rods and affixing the plurality of wall units using the mechanical fastening means. The method further includes providing a frame having a plurality of punches to the wall structure, attaching bottom side of the frame to the threaded tendon rods projecting out of the wall units, attaching top side of the frame to the threaded tendon rods on which the plurality of wall units are to be stacked and attaching vertical sides of the frame to adjacent threaded tendon rods projected out of the plurality of wall units through a connecting bar.

The method further includes providing a beam structure for a roof by building a wall foundation having an inner row and an outer row in such a way that the wall foundation in the outer row includes a plurality of foundation tendon rods projecting above a surface of the wall foundation and the wall foundation in the inner row includes the plurality of foundation tendon rods in a preferred place of the inner row, providing a first set of mechanical fastening means to a threaded end portion of the plurality of foundation tendon rods projecting out of the wall foundation in the inner and outer rows, attaching a first set of threaded tendon rods to the first set of mechanical fastening means, stacking a plurality of wall units on the first set of threaded tendon rods of the inner and outer rows, providing a second set of mechanical fastening means to a threaded end portion of the first set of threaded tendon rods passed through the channel of the plurality of wall units of the inner and outer rows to fasten the plurality of wall units to the wall foundation in the inner and outer rows, creating a wall structure by stacking the plurality of wall units on the threaded tendon rods of the inner row and outer row and affixing the plurality of wall units using the mechanical fastening means, providing a support beam with the end sections placed on the wall units stacked in the inner row of two opponent walls and attaching the support beam to the threaded tendon rods projected out of the surface of the wall unit stacked in the inner row.

Further the method includes providing a covering plate onto the surface of the plurality of wall units on which a roof is supported in such a way that the covering plate is fixed to the threaded tendon rods projected out of the plurality of wall units. A plurality of roof connecters is then attached to the threaded end section of the threaded tendon rods projected out of the surface of the covering plate. Further a plurality of roof rods with threaded end section is attached to the roof connecters of opponent walls thereby forming a network of roof rods interconnecting the walls for building a roof.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
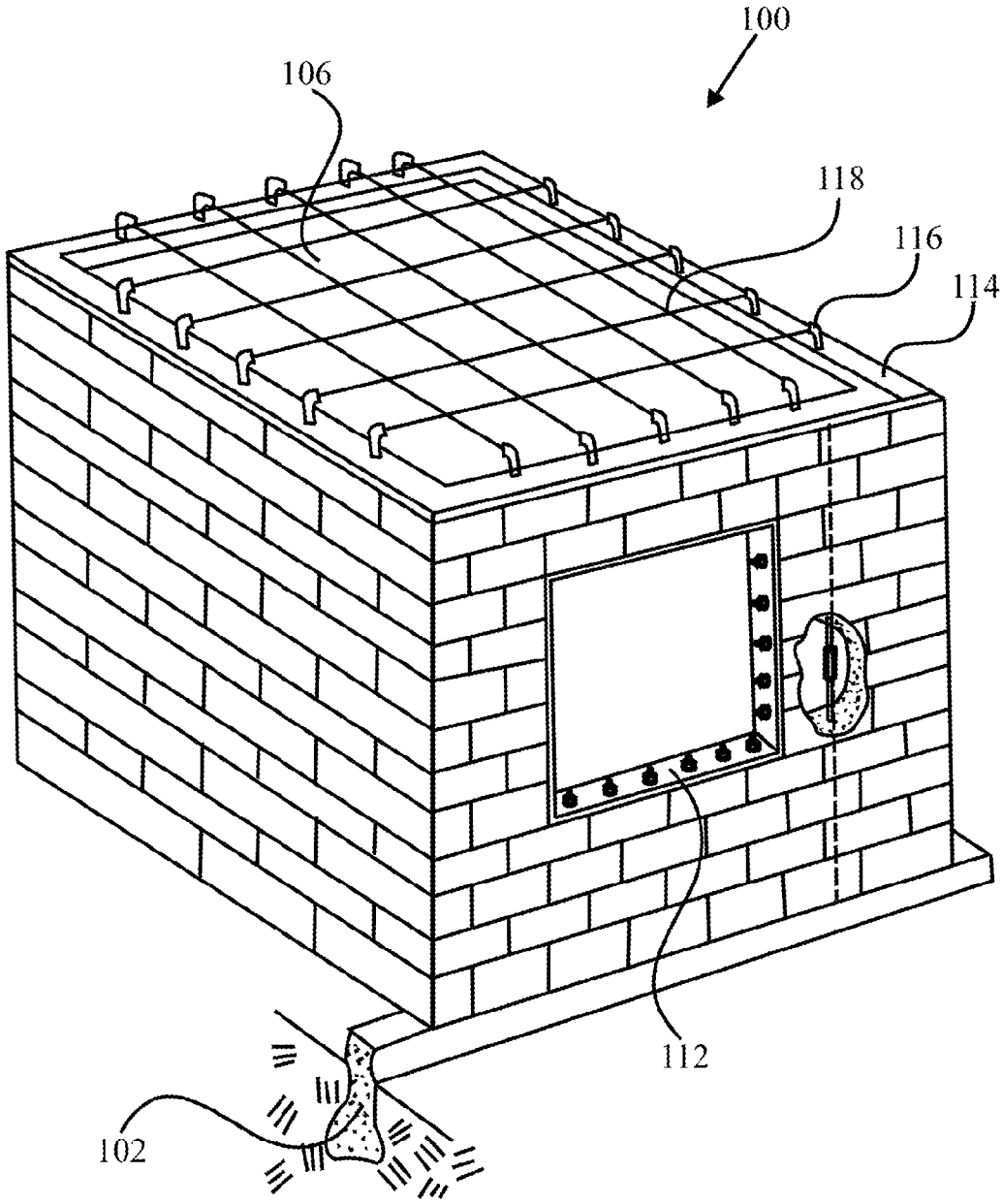
FIG. 1 illustrates a side perspective view of an interlocked mortarless masonry construction system including a slab roof according to one embodiment.

Although the specific features of the present invention are shown in some drawings and not in others. This is done for convenience only as each feature may be combined with any or all of the other features in accordance with the present invention.

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a mortarless construction system using a combination of preformed structures and cast in situ components that can be used to design a variety of building shapes. According to one embodiment, a mortarless construction system includes a wall foundation, wall structures and a slab roof. The base wall foundation includes a plurality of foundation tendon rods having threaded top ends. The foundation tendon rods are rigidly fixed inside the base wall foundation and the threaded top ends of the foundation tendon rods are projected out of the surface of the base wall foundation. The wall structure includes a plurality of wall units, wall unit reinforcement elements, door frames, window frames and covering plates. The slab roof includes a plurality of roof connectors, roof rods and in situ concrete. The wall units of the wall structure are manufactured as standardized units made up of an Ultra High Performance Concrete (UHPC) material which contains metal fiber. The UHPC material has a good strain and stress resistant characteristics. Thus the wall units made up of UHPC material do not need to accommodate any metal or any other material like fiber resistant polymer inside the wall units during the manufacturing process. The unitized and post tensioned UHPC wall units are stronger than an ordinary wall unit built with mortar and standard reinforcing. The wall unit reinforcement elements, covering plates, roof connectors and roof rods of the mortarless construction system are manufactured from materials including, but not limited to, metals such as steel, stainless steel, titanium, brass, aluminum, etc., composite materials such as plastics, reinforced plastics, reinforced resin based materials etc., and other materials used for creating a post tensioning system.

Each wall unit is a rectangular solid block with a top surface including an interlocking element, a bottom surface including a groove or a hollow space to engage the interlocking element on the top surface of the underlying wall unit and a set of opposite side surfaces. The wall unit further includes one or more vertical cavities extending from the bottom surface to the top surface of the interlocking element for accommodating the wall unit retaining elements. At least one side surface of the wall unit includes a vertical locking member and a vertical locking slot respectively. The interlocking elements herein are conical shaped protrusions through which the cavity opens to receive the reinforcing elements. When the wall units are stacked in a horizontal row successively to construct a wall structure, the locking member and the locking slot are aligned in an end-to-end relation with an adjacent horizontally staggered wall unit. The locking member of one wall unit gets interlocked with the locking slot of the adjacent wall unit to prevent the horizontal displacement of the wall units. The interlocking element and the locking member and slot of the wall unit provide dove-tail joints to interlock the wall units without any mortar or cement so as to form a self supporting wall erected without the aid of forms or supports. The wall unit is designed in such a way that the wall unit resists against the shear stresses which affect the wall reinforcement elements.

The wall unit reinforcement elements include a tendon rod having threaded end sections and a mechanical fastening means including a nut, a spring washer and a washer. During the construction of the wall structure, the tendon rod passes through the cavity of the wall unit. The threaded end section of the tendon rod extends outward of the wall unit to receive the mechanical fastening means. The tendon rod herein functions as a post tensioning system in the wall construction to provide a lateral paramount stability to the wall structure. The spring washer of the mechanical fastening means is capable of absorbing seismic waves in case of earth quakes. Also the spring washer is used to prevent cracking of the wall units when the nut is screwed down to connect the wall units together. The covering plate of the wall reinforcement elements such as a structural steel channel member forms the top plate for the wall structure built from the wall units. The covering plate is aligned horizontally on the surface of the upper wall units in a wall structure to prevent from the wall degradation during seismic conditions. The covering plate is provided with holes or openings in a series of row. The holes in the covering plate are adapted to receive the threaded end sections of the tendon rods of the wall structure. The mortarless construction system in the present embodiment is configured with the plurality of adjacent wall units contiguously touching one another and removably coupled to each other using the tendon rods and the mechanical fastening.

A method of building a mortarless construction includes building a base wall foundation, erecting wall structures on the base wall foundation using the wall units and wall reinforcement elements and creating an integral and monolithic slab roof or floor connected to the wall structures. While building the wall foundation, a plurality of foundation tendon rods having threaded end sections are placed distantly inside the wall foundation in a series of row before pouring concrete or other foundation materials for the wall foundation. Then the concrete or other foundation material for the wall foundation is poured and cured in such a way that the threaded end section of the plurality of foundation tendon rods are projected above the top surface of the wall foundation.

After building the wall foundation, a first set of wall retaining means having the washer, the spring washer and the nut are attached to each threaded end section of the foundation tendon rods which are projected out of the wall foundation. The nut is screwed to the threaded end section of foundation tendon rod which is stemmed out of the wall foundation surface in such a way that a portion of the nut is free to receive a successive tendon rod. A first set of tendon rod having both threaded end sections are attached to the remaining half portion of the nut in the first set of mechanical fastening means. Then a plurality of wall units are arranged in a horizontal row on the first set of tendon rods in such a way that the first set of tendon rods pass through the vertical cavity of the plurality of wall units. Each threaded end section of the first set of tendon rods projects out of the top surface of the interlocking element in the plurality of wall units.

Upon arranging the plurality of wall units on the first set of tendon rods, a second set of mechanical fastening means is attached to each threaded end section of the first set of tendon rods which is passed through the vertical cavity of the plurality of wall units. Thus the plurality of wall units arranged in the first row is fastened to the wall foundation by screwing down the nut in the second set of mechanical fastening means. Once the plurality of wall units are fastened to a wall foundation, a second set of tendon rods are attached to upper section of the nut in the second set of mechanical fastening means. Then the plurality of wall units is arranged in a horizontal row onto the second set of tendon rods. Thus the second set of tendon rods are passed through vertical cavity of the plurality of wall units and a threaded end section of the second set of tendon rods are projected above the top surface of the plurality of wall units. Another subsequent set of mechanical fastening means are attached to the threaded end section of the second set of tendon rods which are passed through the cavity of the wall units. So that the plurality of wall units stacked on the second set of tendon rods are fastened to the plurality of wall units stacked on the first set of tendon rods. Hence a wall structure is built by vertically stacking the plurality of wall units onto the tendon rods and affixing the plurality of wall units using the mechanical fastening means to the underlying wall units.

The doors and windows of the wall structure are placed inside a frame such as a metal frame or any of a suitable material. The frame bears the weight of the rest of the building which is on the upper side of the frame. The frame includes punches drilled at appropriate distance. The distance between the punches and the length of the vertical cavity in the wall units are equal. In order to place the frame for the door/window, the wall units intersecting with the frame is provided with a flat surface to form a plane surface for placing the door and window frame without leaving any gap between the frame and the wall unit. Also the height of tendon rods in the wall units having the flat surface is adjusted. The threaded end sections of the tendon rods which are projected out of the flat surface of the wall units are passed through the punches in the frame and attached to the frame using the mechanical fastening means having the nut, the spring washer and the washer.

The vertical sides of the frame are attached to the tendon rods extending out from the adjacent wall units on the vertical sides of the frame using a connector bar such as 90 degree angle connector. One end section of the connector bar is attached to the tendon rod extending from the adjacent wall unit and other end is attached to the vertical side of the frame. The at least one threaded end sections of the plurality of tendon rods are inserted to the punches in the top side of the frame and attached to the top side of the frame using the mechanical fastening means. Then the plurality of wall units is stacked on these tendon rods to complete the wall structure. Hence the frame for door/window is designed in such a way that the frame bears incoming forces such as gravity force and lateral loads caused during an earthquake.

When the wall structure is built to ceiling height, a plurality of wall units which include the flat top surface is placed on the final tendon rods of the wall structure. The wall units with top flat surface are arranged in such a way that the final tendon rods of the wall structure are projected above the flat surface of the plurality of wall units. The plurality of wall units having the flat top surface is also used for creating door and/or window frames in the wall structure. The difference between the row of wall units aligned adjacent to the ceiling and the other wall units in the wall structure is in eliminating the interlocking elements such as the conical shapes on the final row of wall units.

A covering plate is fixed onto the flat surface of the plurality of wall units on which a roof is supported in such a way that the threaded end section of the tendon rods of a wall which are projected out of the flat surface of the plurality of wall units, pass through holes in the covering plate and projected out of the surface of the covering plate. The height of the tendon rods which are used to fix the flat surfaced wall units is different from the tendon rods used for other wall units, because of the difference in the shape of the wall units and the thickness of the covering plate.

For constructing the slab roof or the floor, a plurality of roof connectors is attached to the threaded end sections of the tendon rods of the wall structure which are projected out of the surface of the covering plate using the mechanical fastening means. The roof connector includes multiple way connectors such as two way connectors, three way connectors, five way connectors, six way connectors or 90 degree elbow connectors. For example, the two way roof connector is used in a single floor mortarless construction or in the top most roof in the multi-storey mortarless construction. The three way roof connector is used for connecting the roof to the side walls of a middle floor in a few storey mortarless construction. The five way roof connector is used for connecting the roof to the middle walls in the top most roof in the multi-storey mortarless construction. The six way roof connector is used for connecting the roof to the middle wall in the middle roofs of a few storey mortarless construction.

A plurality of roof rods having threaded end sections is attached in between the horizontal end of the roof connectors and a coupling which is attached to a pipe union and then to a bell reducer to form an adequate tension in the roof rods. The bell reducer is attached to the corresponding roof connector of the opponent walls. The roof rods are metallic or of any other fiber resistant polymer material. Thus a network of roof rods interconnecting the walls is formed for building the roof. The horizontal crossed roof rods are connected together in the cross section with a soft wire. Metal sheets are then placed temporary underneath the roof rods. A layer of a settable cementing material such as UHPC material is poured onto the roof rods and allowed to set to form a concrete layer. The concrete layer is placed such that it covers the surface of the covering plate. The skeleton of roof rods and the roof connectors which are located inside the poured concrete provides for the strength of the roof in mortarless construction.

In the method of providing a beam structure for a roof in a mortarless construction, the wall foundation needs to be built thicker than of the normal wall foundation in the mortarless construction. Thus the foundation is constructed in such a way that the foundation includes two layers, an inner row and an outer row. The outer row of the wall foundation includes a plurality of foundation tendon rods projecting above the surface of the wall foundation and the inner row includes a plurality of foundation tendon rods arranged at places where a beam support wall is to be formed. The first set of mechanical fastening means having the nut, the spring washer and the washer is attached to the threaded end sections of the plurality of foundation tendon rods projecting out of the wall foundation in the inner and outer rows. The first set of tendon rods having threaded end sections is attached to the first set of mechanical fastening means. The plurality of wall units is stacked in a series of row on the first set of tendon rods of the inner and outer rows in such a way that the first set of tendon rods passes through the cavity of the plurality of wall units and the at least one threaded end section of the first set of tendon rods projects out of the top surface of the plurality of wall units of the inner and outer rows.

Upon arranging the plurality of wall units on the first set of tendon rods, the second set of mechanical fastening means are attached to each threaded top end portion of the first set of tendon rods which is passed through the vertical cavity of the plurality of wall units of the inner and outer rows. Thus the plurality of wall units arranged in the inner and outer rows is fastened to the base wall foundation by screwing the nut in the second set of mechanical fastening. Once the plurality of wall units are fastened to base wall foundation, the second set of tendon rods are attached to upper section of the nut in the second set of mechanical fastening means. Then a plurality of singular wall units which are in square shape is arranged horizontally onto the second set of tendon rods in the inner and outer rows. Thus the second set of tendon rods are passed through the vertical cavity of the plurality of singular wall units such that at least one threaded end section of the second set of tendon rods are projected above the top surfaces of the plurality of singular wall units. Subsequently another set of mechanical fastening means are attached to the threaded end section of the second set of tendon rods. These tendon rods are then passed through the cavity of the wall units to fasten the plurality of singular wall units stacked on the second set of tendon rods to the plurality of wall units stacked on the first set of tendon rods. Hence a wall structure is built on the inner and outer rows of the wall foundation by vertically stacking the plurality of wall units and the plurality of singular wall units consecutively onto the tendon rods and affixing the plurality of wall units using the mechanical fastening means to the underlying wall units.

When the wall structure attains the ceiling height, a support beam having ends is placed on the wall units having the flat top surface stacked in the inner row of two opponent walls. The support beam is provided in the mortarless construction to bear the roof load when the distance between the opponent walls is more. The support beam is attached to the tendon rods projected out of the flat surface of the wall units which are stacked on the inner row. The covering plate is fixed onto the flat surface of the wall units stacked on the outer row in such a way that the threaded end sections of the tendon rods projects out of the surface of the wall units stacked in the outer row is passed through the holes in the covering plate and gets attached to the top surface of the covering plate. Then the plurality of roof connecters are attached to the threaded end section of the tendon rods projected out of the surface of the covering plate. The plurality of roof rods having threaded ends are attached to the roof connecters of opponent walls in such a way that a cross network of roof rods is formed over the walls for building the roof above the support beam. When the concrete for the roof is poured on the cross networks of roof rods, the concrete layer is formed on the upper part of the beam.

FIG. 1 illustrates a side perspective view of an interlocked mortarless masonry construction system including a slab roof according to one embodiment of the present invention. With respect to FIG. 1, a mortarless construction system 100 includes a wall foundation 102, wall structures 104 and a slab roof 106. The base wall foundation 102 includes a plurality of foundation tendon rods having at least one threaded end section. The foundation tendon rods are fixed inside the wall foundation 102 and the threaded end section of the foundation tendon rods are projected out of the surface of the base wall foundation 102. The wall structure 104 includes a plurality of wall units 108, wall unit reinforcement elements, window frame 112 and covering plates 114. The slab roof 106 includes a plurality of roof connectors 116, roof rods 118 and in situ concrete. The wall units 108 of the wall structure 104 are manufactured as standardized units made up of an Ultra High Performance Concrete (UHPC) material, which contains metal fiber. The wall unit reinforcement elements, covering plates 114, roof connectors 116 and roof rods 118 of the mortarless construction system 100 are manufactured from materials including, but not limited to, metals such as steel, stainless steel, titanium, brass, aluminum etc., composite materials such as plastics, reinforced plastics, reinforced resin based materials etc., and other materials used for creating a post tensioning system.

The wall structure 104 is constructed on the base wall foundation 102 by attaching the wall unit reinforcement elements on the base wall foundation 102 and stacking the wall units 108 having a number of vertical cavities on the wall unit reinforcement elements. The wall structure 104 is constructed with a door or window frame 112. The covering plates 114 are fixed on the top surface of the wall structures 104. Further, the slab roof 106 is constructed on the wall structures 104 by attaching the wall reinforcement elements 110 to the roof connectors 116 and to the roof rods 118 and further pouring a concrete material on the roof rods 118 arranged in the form of a mesh network.

Figure 2:
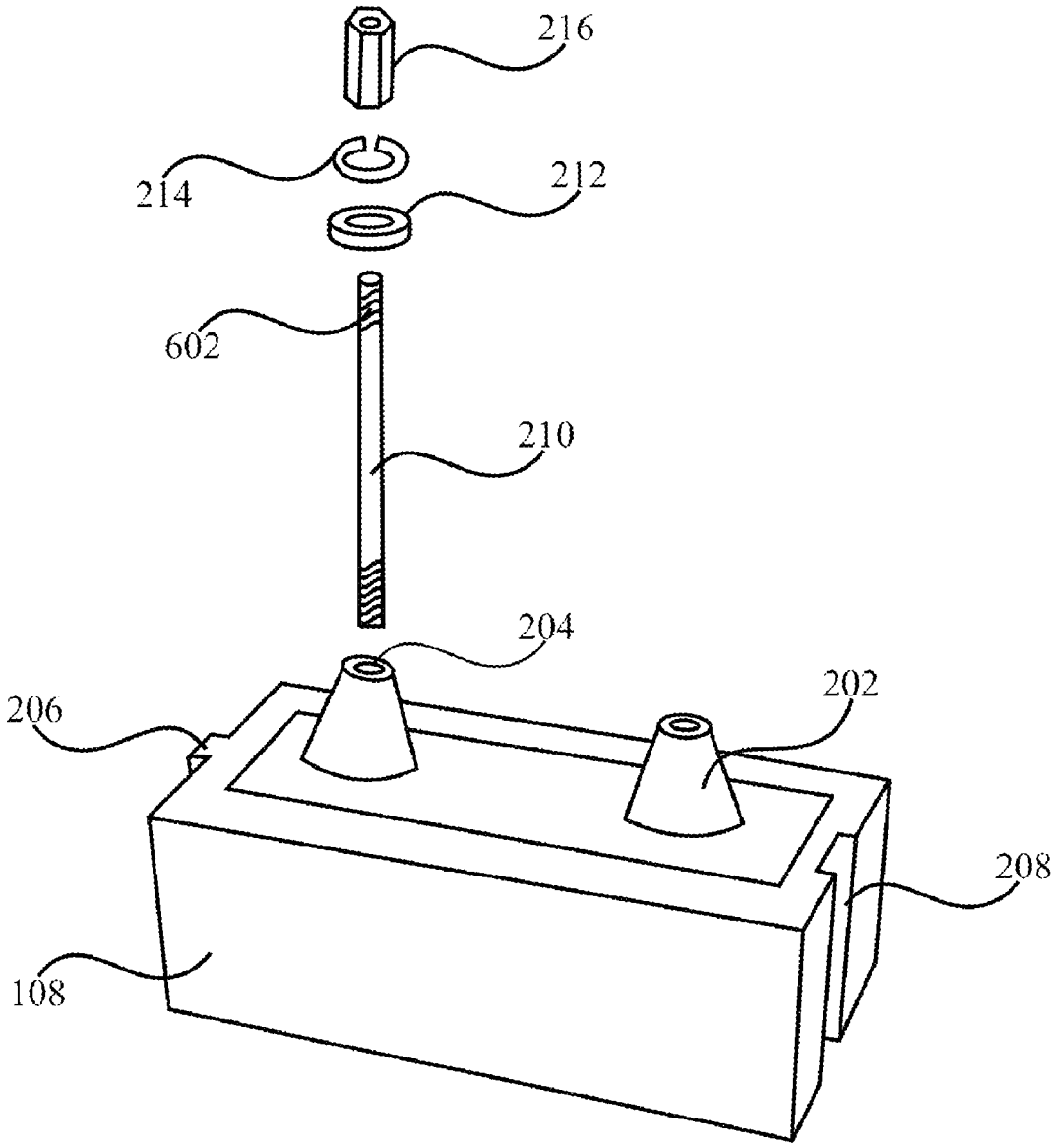
FIG. 2 illustrates an exploded view of a wall unit with the wall unit reinforcement elements for use in a mortarless construction system according to one embodiment.

FIG. 2 illustrates an exploded view of a wall unit with the wall unit reinforcement elements for use in a mortarless construction system according to one embodiment of the present invention. With respect to FIG. 2, the wall unit 108 is a rectangular solid block with a top surface including one or more interlocking elements 202, a bottom surface including a groove or a hollow space to engage the interlocking element 202 placed on the top surface of the underlying wall unit, one or more vertical cavity 204 extending from the bottom surface of the wall unit 108 to top surface of the interlocking element 202 for accommodating the wall unit reinforcement elements and a set of opposite end side surfaces. Each end side surface of the wall unit 108 includes a locking member 206 and a locking slot 208 respectively. The wall unit 108 is manufactured as a standardized unit made up of a UHPC material which contains metal fiber. The interlocking elements 202 as shown herein are conical shaped projections provided on the top surface of the wall unit 108.

The locking member 206 and the locking slot 208 are provided at the opposite side surfaces such that when the wall units 108 are stacked in a horizontal row successively to construct a wall structure, the locking member 206 and the locking slot 208 adjoins with the adjacent horizontally staggered wall unit to interlock with each other. The interlocking element 202 and the locking member 206 and the locking slot 208 of the wall unit 108 provide dove-tail joints to interlock the wall units 108 without any mortar or cement so as to form a self supporting wall erected without the aid of any supporting structure. The wall unit 108 is designed in such a way that the wall unit 108 resists against shear stresses which affect the wall reinforcement elements.

The wall unit reinforcement elements include a longitudinally extending tendon rod 210 having threaded end sections and mechanical fastening means including a washer 212, a spring washer 214 and a coupling nut 216. During the construction of the wall structure, the tendon rod 210 is passed through the vertical cavity 204 of the wall unit 108. At least one threaded end section of the tendon rod 210 extends outward of the wall unit to receive the mechanical fastening. The tendon rod 210 functions as a post tensioning system in the wall construction to provide a lateral paramount stability to the wall structure.

The top threaded end section of the tendon rod 210 extends outward of the wall unit 108 to receive the washer 212, the spring washer 214 and the coupling nut 216. The washer 212 of the mechanical fastening means is typically a disk-shaped thin plate with an opening in the center. The washer 212 is used to distribute the load of a threaded fastener. The washer 212 provides a tight fit for the coupling nut 216 onto the tendon rod.

The spring washer 214 is a metal disk that is formed in an appropriate shape such as a circular shape. The spring washer 214 is used to absorb seismic waves in the mortarless construction system. Also the spring washer 214 is used to prevent the wall unit from cracking when the coupling nut is screwed down to draw the wall units together.

With respect to FIG. 2, the coupling nut 216 includes a threaded inner portion. The coupling nut 216 is screwed to the tendon rod in the mortarless construction system in such a way that half a portion of the coupling nut 216 accommodates a threaded end section of a tendon rod and the remaining half of the coupling nut 216 accommodates a threaded end section of the tendon rod placed to vertically arrange another wall unit.

Figure 3:
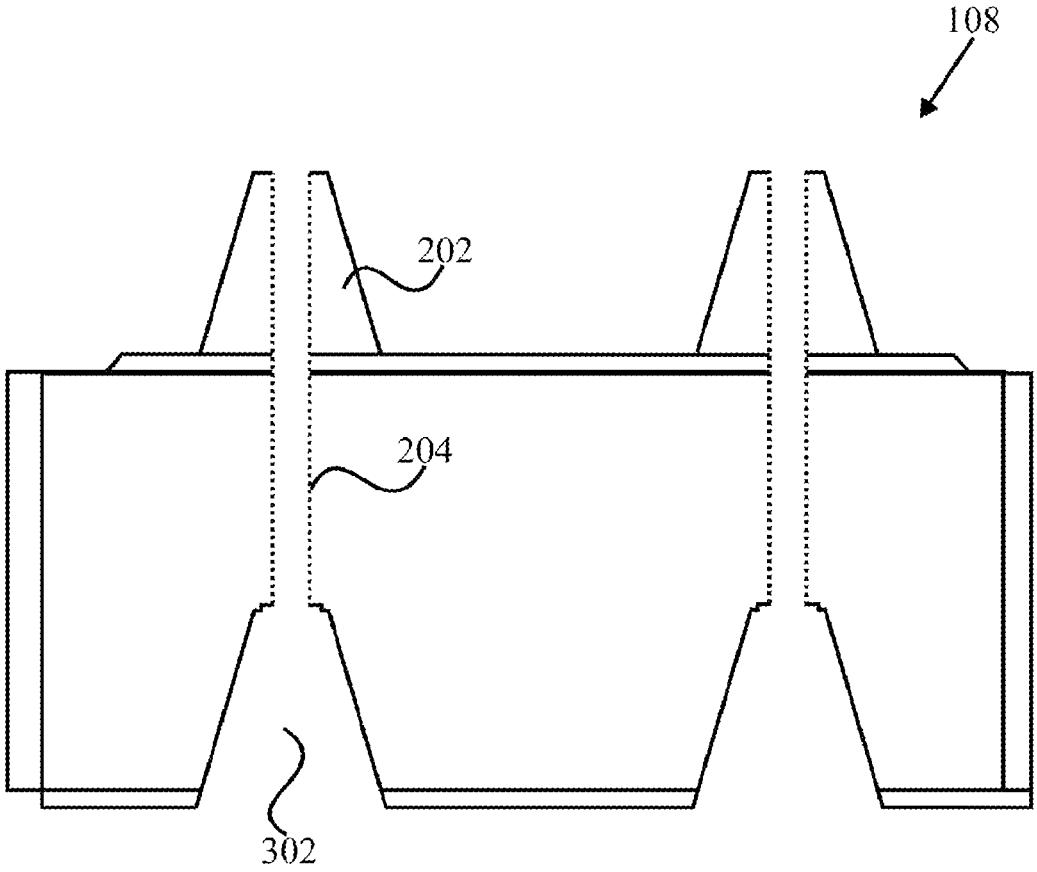
FIG. 3 illustrates a cross sectional view of a wall unit in a mortarless construction system according to one embodiment.

FIG. 3 illustrates a cross sectional view of a wall unit in a mortarless construction system according to one embodiment of the present invention. With respect to FIG. 3, the wall unit 108 includes one or more interlocking elements 202 at the top surface, a groove or a hollow space 302 to engage the interlocking element 202 on the top surface of the underlying wall unit, one or more vertical cavity 204 extending from along the interior of the wall unit for accommodating the wall unit reinforcement elements.

Figure 4:
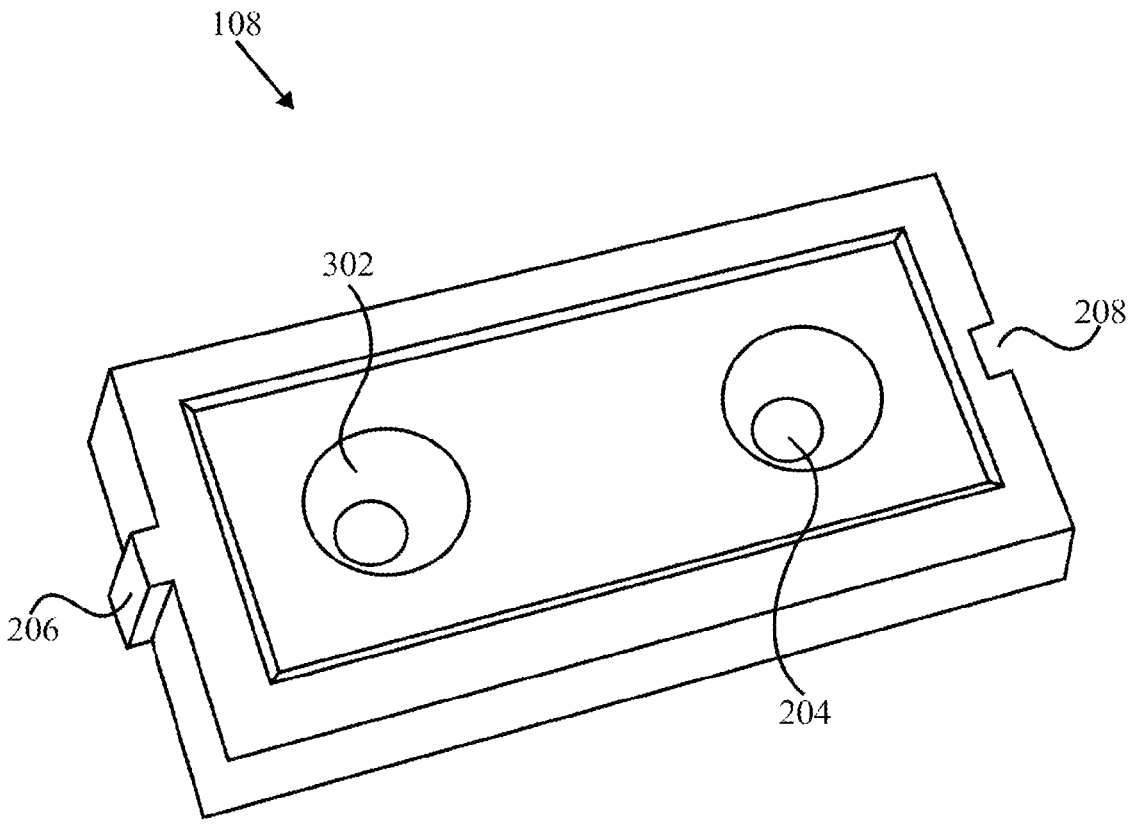
FIG. 4 illustrates a bottom perspective view of a wall unit in a mortarless construction system according to one embodiment.

FIG. 4 illustrates a perspective bottom view of a wall unit in a mortarless construction system according to one embodiment of the present invention. With respect to FIG. 4, the wall unit 108 includes one or more grooves or the hollow spaces 302 on the bottom surface. The hollow spaces 302 are shaped to adapt the interlocking element of the wall unit. The hollow space 302 is of appropriate size so as to engage with the interlocking elements placed on the top surface of the underlying wall unit to provide a close connection between the wall units. The wall unit 108 includes one or more vertical cavity 204 extending from the bottom surface of the wall unit 108 to top surface of the interlocking element for accommodating the wall unit reinforcement elements. Each end side surface of the wall unit 108 includes a locking member 206 and a locking slot 208 respectively.

Figure 5A:
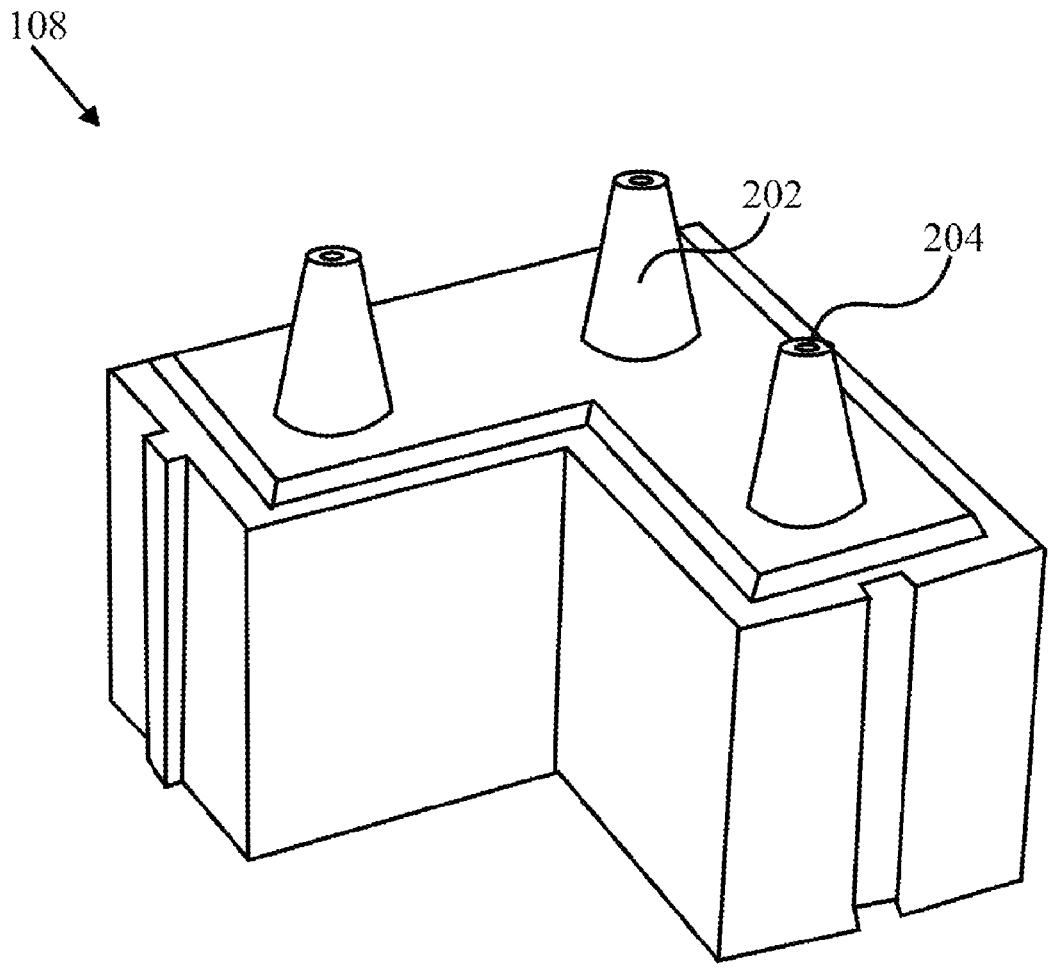
FIGS. 5A-5C illustrates perspective view of various kinds of wall units of a mortarless construction system according to one embodiment.
Figure 5B:
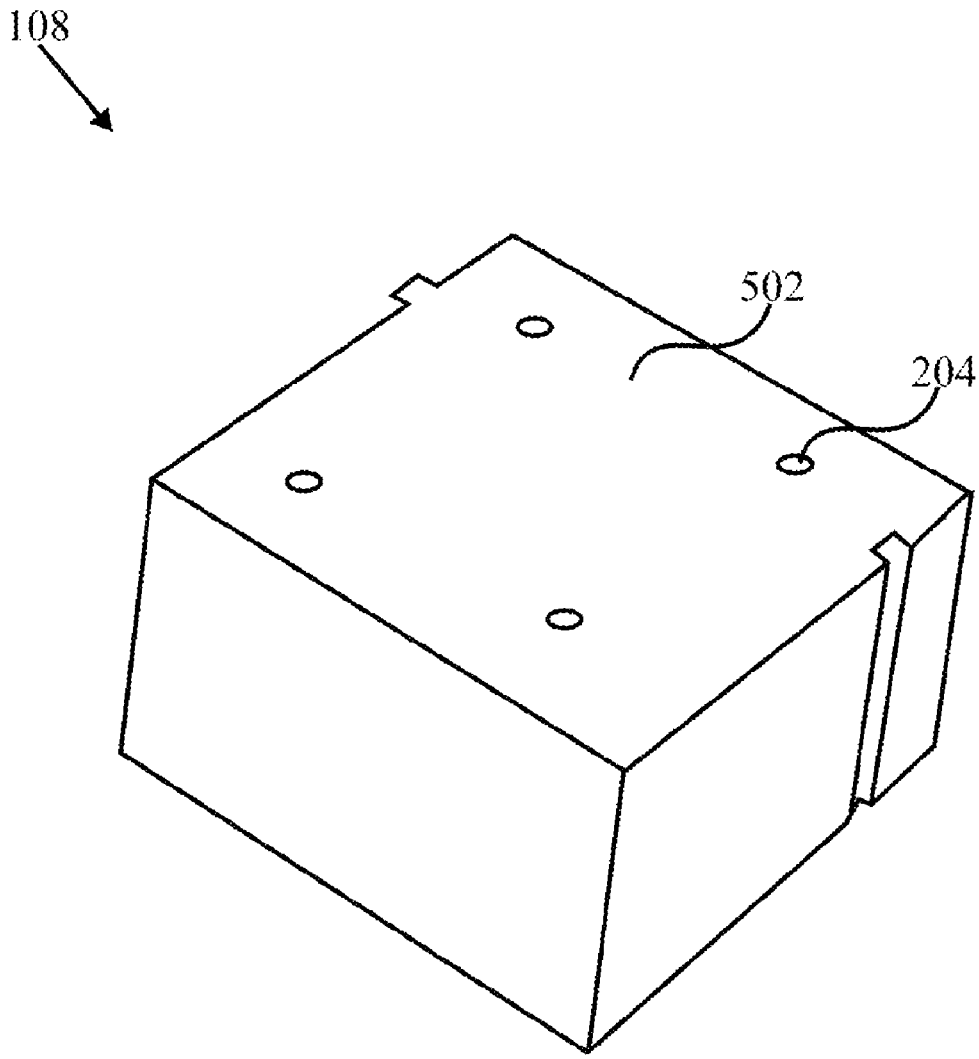
Figure 5C:
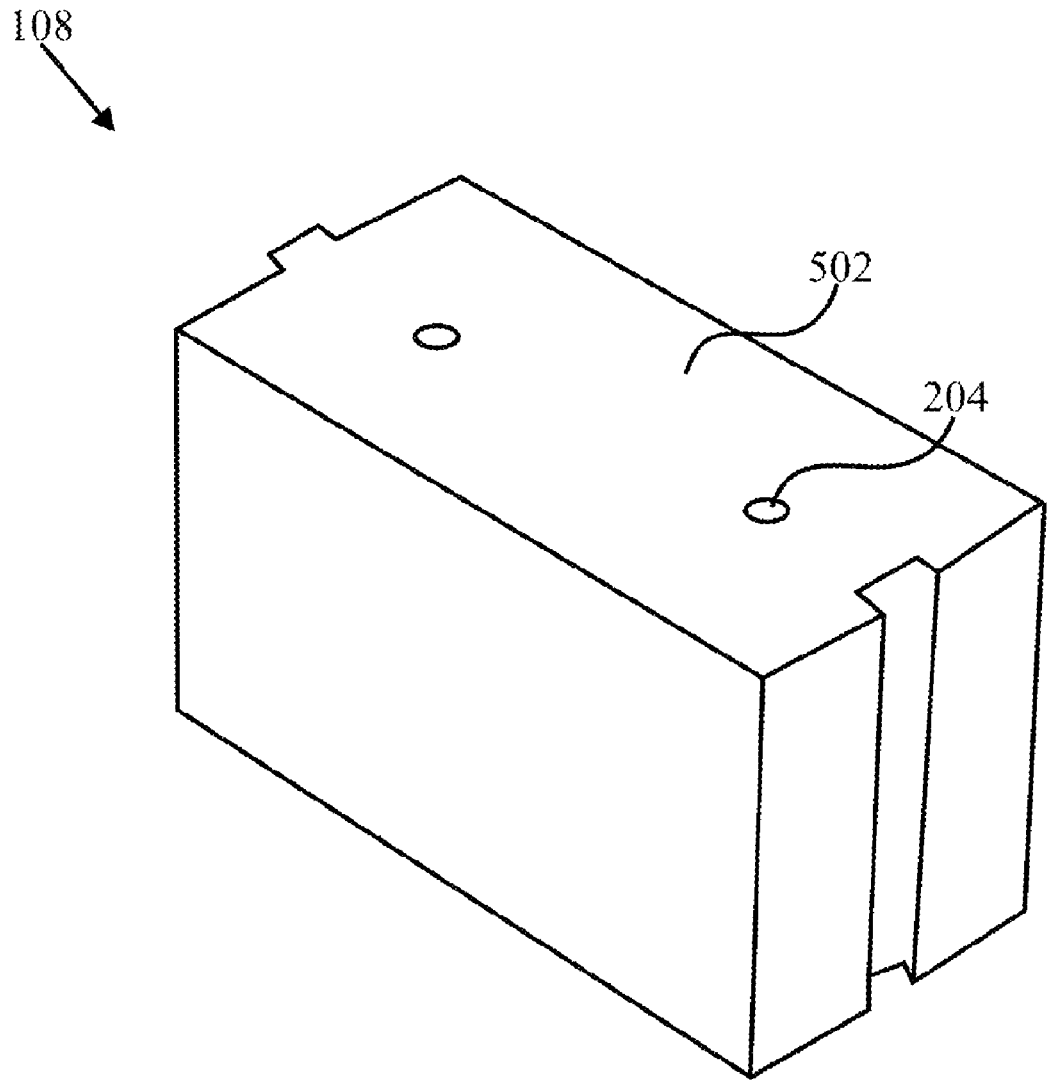

FIGS. 5A-5C illustrates a perspective view of various kinds of wall units of a mortarless construction system according to one embodiment of the present invention. A wall unit 108 includes a single interlocking element 202 at top surface and the vertical cavity 204 for accommodating the wall unit reinforcement elements. With respect to FIG. 5A, a wall unit 108 is a L-shaped wall unit including three interlocking elements 202 at top surface and three vertical cavities 204 for each interlocking element 202. With respect to FIG. 5B, a wall unit 108 includes a flat surface 502 at the top surface of wall unit without any interlocking element and four vertical cavities 204 arranged in an equally spaced manner. This kind of wall unit 108 is placed on the top row of a wall structure adjacent to the ceiling in the mortarless construction system on which the covering plate is placed. The covering plate is placed flat on the top surface of the wall unit such that gap is not formed between the covering plate and the wall unit. Also the wall unit 108 is placed beneath the door and window frame for providing support to the door and window frame. With respect to FIG. 5C, a wall unit 108 includes the flat surface 502 on the top and two interlocking elements 202 defining the vertical cavity 204. The wall unit 108 is also molded with four or five interlocking elements arranged in different patterns such as line, square or the like to ensure the securing of the wall unit retaining elements.

Figure 6:
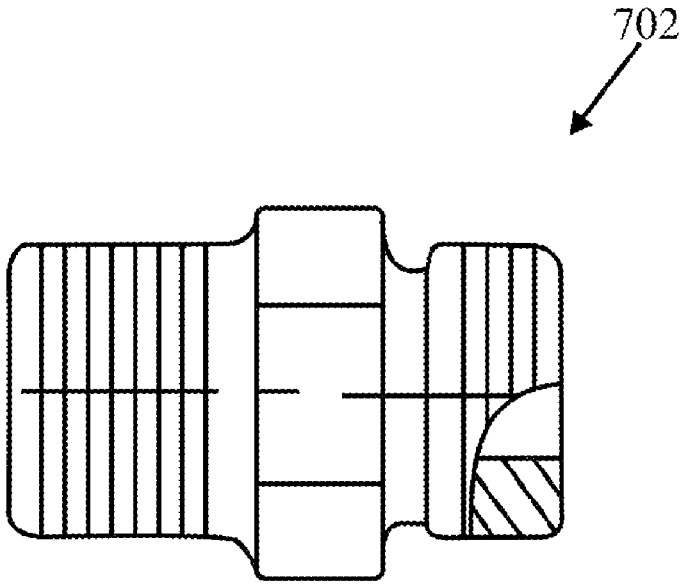
FIG. 6 illustrates a perspective view of a pipe union used for a slab roof in the mortarless construction system according to one embodiment.

FIG. 6 illustrates a perspective view of a pipe union used for a slab roof in the mortarless construction system according to one embodiment of the present invention. With respect to FIG. 6, a pipe union 702 is a pipe having threaded end sections. The pipe union 702 interfaces the coupling nut connected to the roof rods to a bell reducer in the slab roof system. The pipe union 702 is used to provide an adequate tension in the roof rods of the mortarless construction system.

Figure 7:
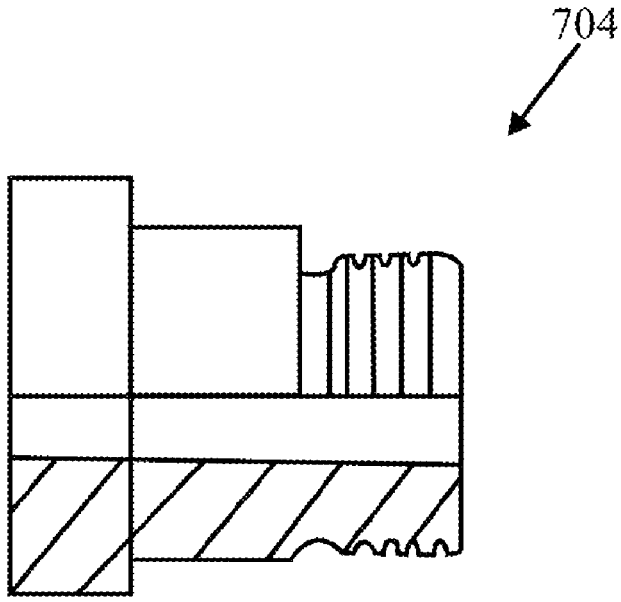
FIG. 7 illustrates a perspective view of a bell reducer used for the slab roof in the mortarless construction system according to one embodiment.

FIG. 7 illustrates a perspective view of a bell reducer used for the slab roof in the mortarless construction system according to one embodiment of the present invention. With respect to FIG. 7, a bell reducer 704 is a connecting shaped like a bell which has one opening of a smaller diameter at one end section and an opening of larger diameter at another end section. The end section with the larger diameter is connected to the roof connector and the end section with smaller diameter is attached to the pipe union. The bell reducer 704 is used to provide an adequate tension in the roof rods of the mortarless construction system.

Figure 8A:
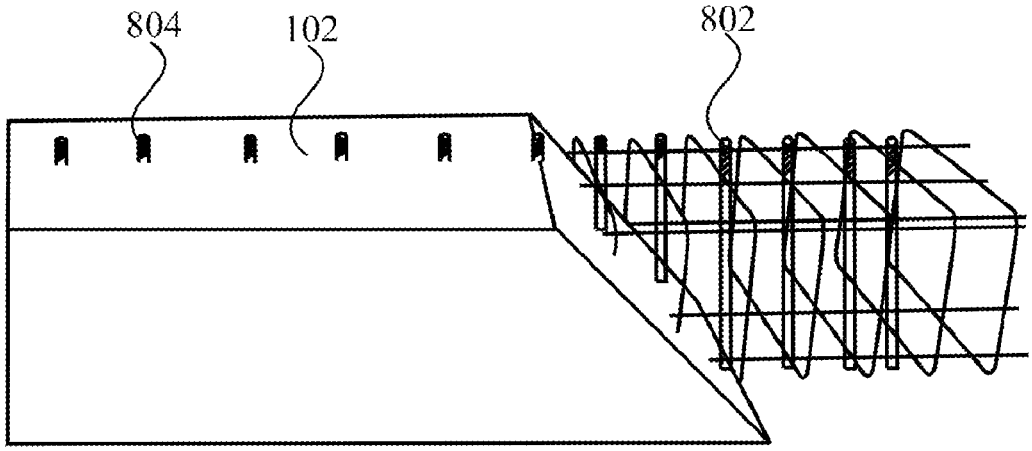
FIG. 8A illustrates a perspective view of a wall foundation with foundation tendon rods in a mortarless construction system according to one embodiment.

FIG. 8A illustrates a perspective view of construction of a wall foundation with foundation tendon rods in a mortarless construction system according to one embodiment of the present invention. With respect to FIG. 8A, a base structure made of metal rods interconnected in a predefined pattern with a plurality of rods extending above the defined height for the foundation is provided. Further concrete is poured on to the base structure to provide a rigid wall foundation. The plurality of foundation tendon rod 802 extending above the base structure has threaded end sections 804. The plurality of foundation tendon rods 802 are placed distantly inside the wall foundation 102 in a series of row before pouring concrete or other foundation materials for the wall foundation 102. The concrete or other foundation material for the wall foundation 102 is poured and cured in such a way that the threaded top end sections 804 of the plurality of foundation tendon rods 802 are projected above a top surface of the base wall foundation 102.

Figure 8B:
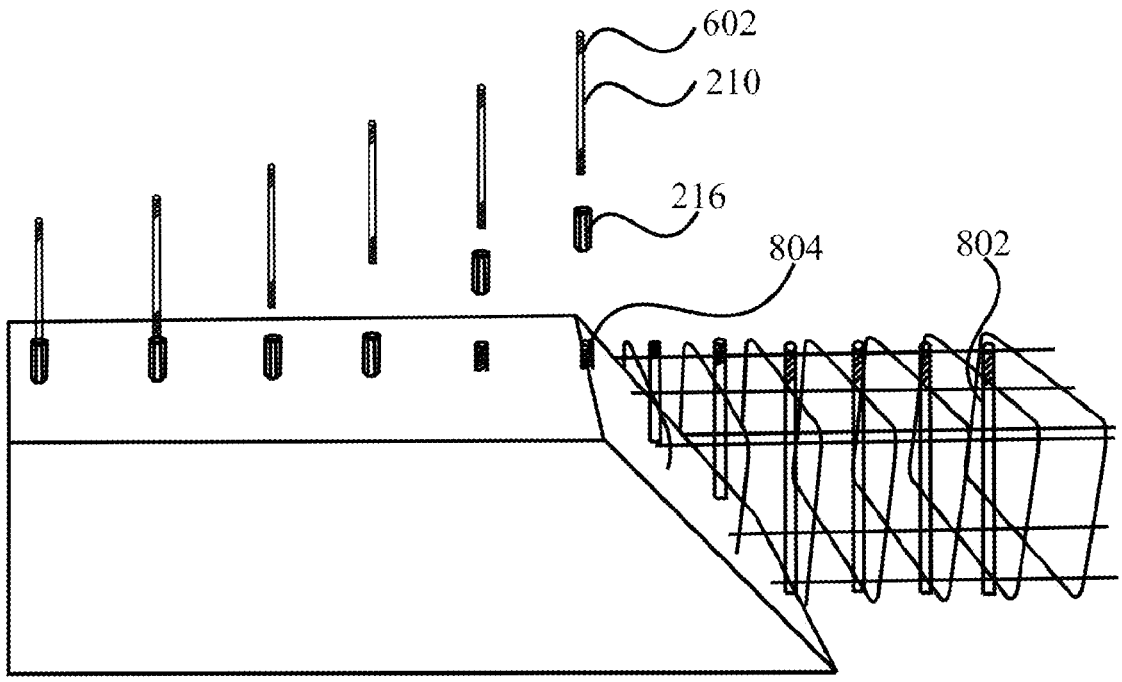
FIG. 8B illustrates an exploded perspective view of an assembly of fastening means secured to the wall foundation in the mortarless construction system according to one embodiment.

FIG. 8B illustrates a perspective view showing the assembling of fastening means on to the wall foundation in the mortarless construction system according to one embodiment of the present invention. With respect to FIG. 8B, after building the base wall foundation 102, the coupling nut 216 is provided to each threaded end section 804 of the foundation tendon rods 802 which are projected out of the wall foundation 802. The coupling nut 216 is screwed to the end section 804 of the foundation tendon rod 802, which is stemmed out of the wall foundation surface in such a way that a portion of the coupling nut 216 is free to receive a successive tendon rod 210. A first set of tendon rods 210 having threaded end sections 602 are attached to the remaining portion of the coupling nut 216.

Figure 8C:
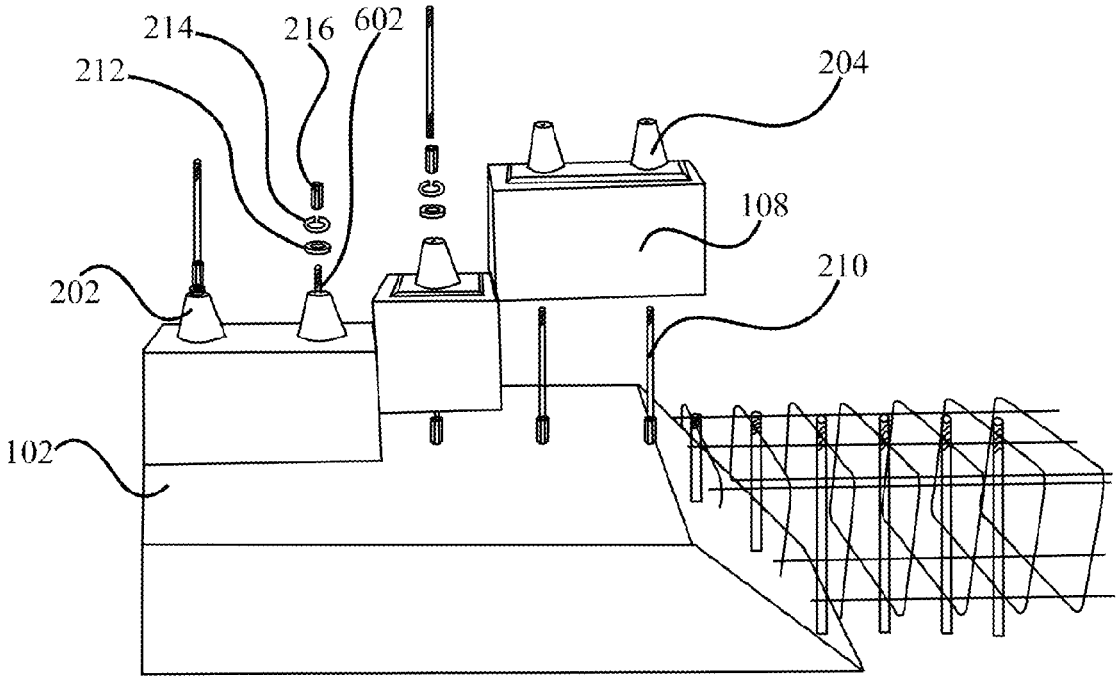
FIG. 8C illustrates an exploded perspective view of the wall foundation with the arrangement of the wall units in the mortarless construction system according to one embodiment.

FIG. 8C illustrates a perspective view of the wall foundation illustrating the arrangement of the wall units in the mortarless construction system according to one embodiment of the present invention. With respect to FIG. 8C, after attaching the first set of tendon rods 210 to the base wall foundation 102, a plurality of wall units 108 is arranged in a horizontal row on the first set of tendon rods 210 in such a way that the first set of tendon rods 210 pass through the vertical cavity 204 of the plurality of wall units 108. The plurality of wall units 108 is placed on the tendon rod such that at least one threaded end section 602 of the first set of tendon rods 210 is projected out of the top surface of the interlocking element 202 in the plurality of wall units 108. Upon arranging the plurality of wall units 108 on the first set of tendon rods 210, a second set of mechanical fastening means having the washer 212, the spring washer 214 and the coupling nut 216 is attached to each threaded end section of the first set of tendon rods 210 which is passed through the vertical cavity of the plurality of wall units. Thus the plurality of wall units 108 arranged in the first row is fastened to the wall foundation 102 by screwing down the coupling nut 216 in the second set of mechanical fastening means. Once the plurality of wall units 108 are fastened to the wall foundation 102, a second set of tendon rods 210 are attached to upper section of the coupling nut 216 of the second set of mechanical fastening means. Then the plurality of wall units 108 is arranged in a horizontal row onto the second set of tendon rods 210. Thus the second set of tendon rods 210 are passed through vertical cavity of the plurality of wall units 108 and a top threaded end portion of the second set of tendon rods 210 are projected above the top surfaces of the plurality of wall units 108. Another subsequent set of mechanical fastening means are attached to the threaded end section of the second set of tendon rods 210 which are passed through the cavity of the wall units 108. The plurality of wall units 108 stacked on the second set of tendon rods are 210 fastened to the plurality of wall units 108 stacked on the first set of tendon rods 210. Hence a wall structure is built by vertically stacking the plurality of wall units 108 onto the tendon rods 210 and affixing the plurality of wall units 108 using the mechanical fastening means to the underlying wall units.

Figure 9:
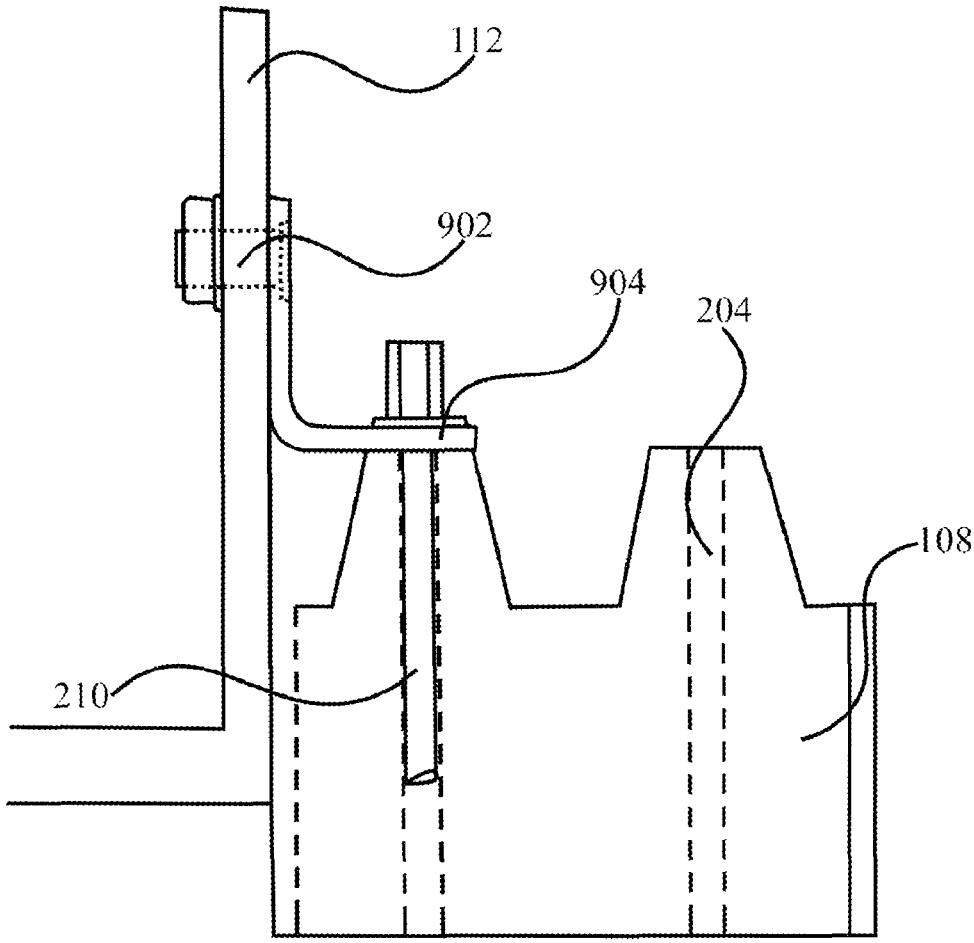
FIG. 9 illustrates a sectional view of a vertical side of a window frame attached to a wall unit in a mortarless construction system according to one embodiment.*

FIG. 9 illustrates a sectional view of a vertical side of a window frame attached to a wall unit in a mortarless construction system according to one embodiment of the present invention. With respect to FIG. 9, the window frame 112 includes at least one hole 902 drilled at a specific distance. The distance between adjacent the holes 902 and the length of the vertical cavity 204 in the wall units 108 are equal. The vertical sides of the frame 112 is connected to the tendon rods 210 passing through the vertical cavity 204 of the adjacent wall units 108 using a connector bar 904 such as 90 degree angle connector. One end section of the connector bar 904 is attached to the tendon rod 210 passing through the adjacent wall unit 108 and other end is attached to the vertical side of the frame 112.

Figure 10:
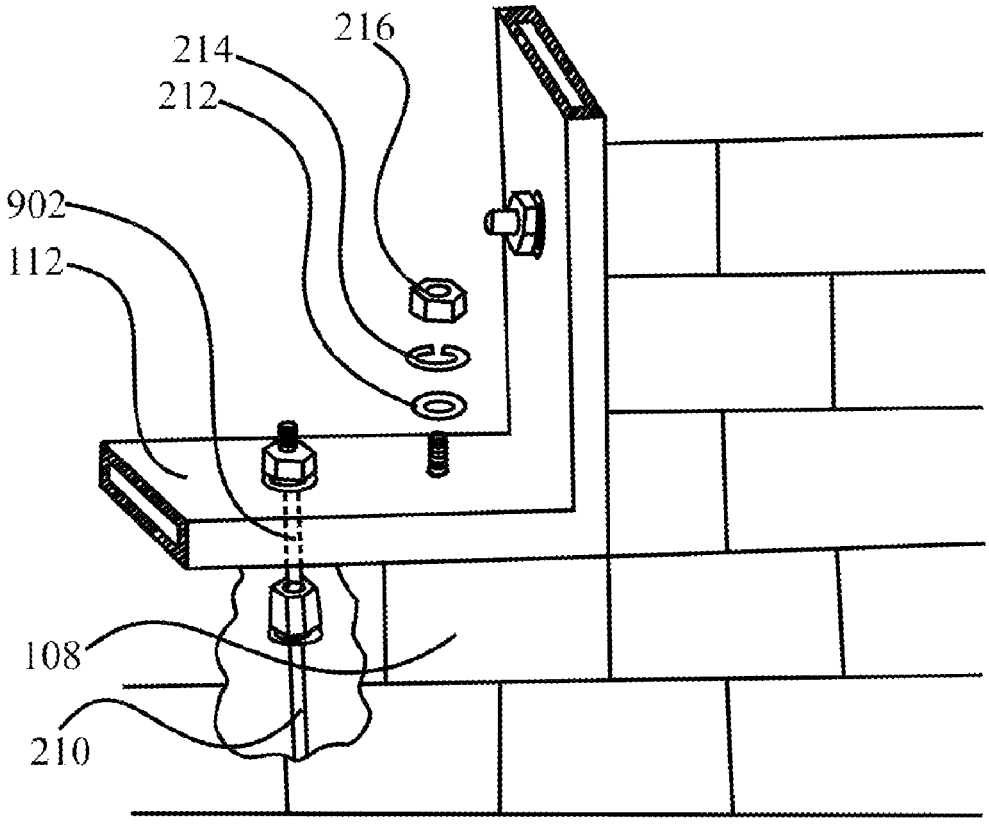
FIG. 10 illustrates an exploded perspective view the positioning of a window frame to a wall structure of a mortarless construction system according to one embodiment.

FIG. 10 illustrates the positioning of a window frame to a wall structure of a mortarless construction system according to one embodiment of the present invention. With respect to FIG. 10, the window frame 112 cut a few of tendon rods 210 in the wall structure during the assembly process of the door or the window. In order to place the frame 112 for the door/window, the wall units 108 placed right under the bottom side of the frame 112 are provided with a flat surface to form a plane surface for placing the door and window frame 112. Also the height of tendon rods 210 in the wall units 108 having the flat surface is adjusted. The threaded end sections of the tendon rods 210 which are projected out of the flat surface of the wall units 108 are passed through the holes 902 in the bottom side of the frame 112 and attached to the door and window frame 112 using the mechanical fastening means having the washer 212, the spring washer 214 and the nut 216.

Figure 11:
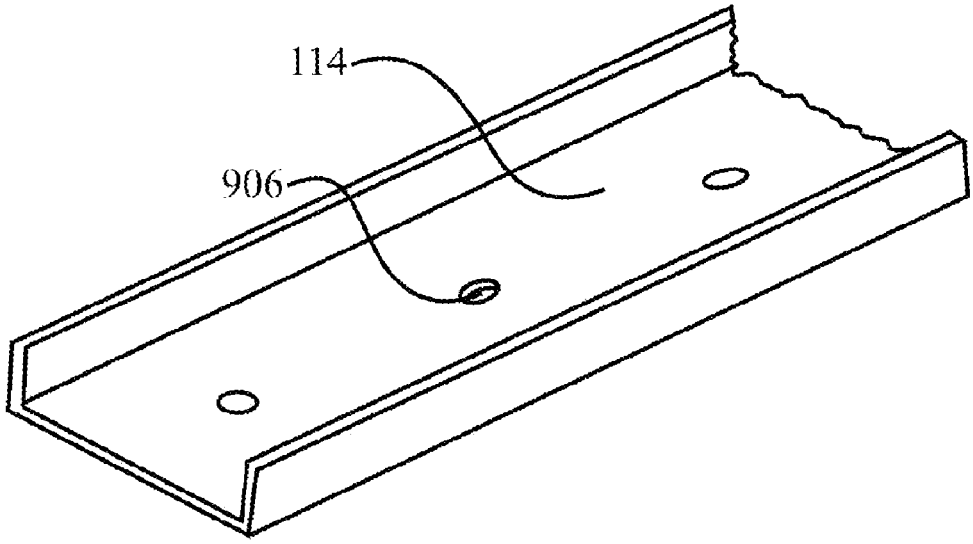
FIG. 11 illustrates a perspective view of a covering plate for the wall structure in the mortarless construction system according to one embodiment.

FIG. 11 illustrates a side perspective view of a covering plate for the wall structure in the mortarless construction system according to one embodiment of the present invention. With respect to FIG. 11, the covering plate 114 is an elongated channel fixed on the top of the wall structure in the mortarless construction system. The covering plate is made of a metal such as steel or any other polymeric material. The covering plate 114 is aligned on the surface of the top most wall units of a wall structure horizontally to prevent the wall from degradation during seismic conditions. The covering plate 114 is provided with holes or openings 906 in a series of row. The holes 906 in the covering plate 114 are adapted to receive the threaded end sections of the tendon rods of the wall structure.

Figure 12:
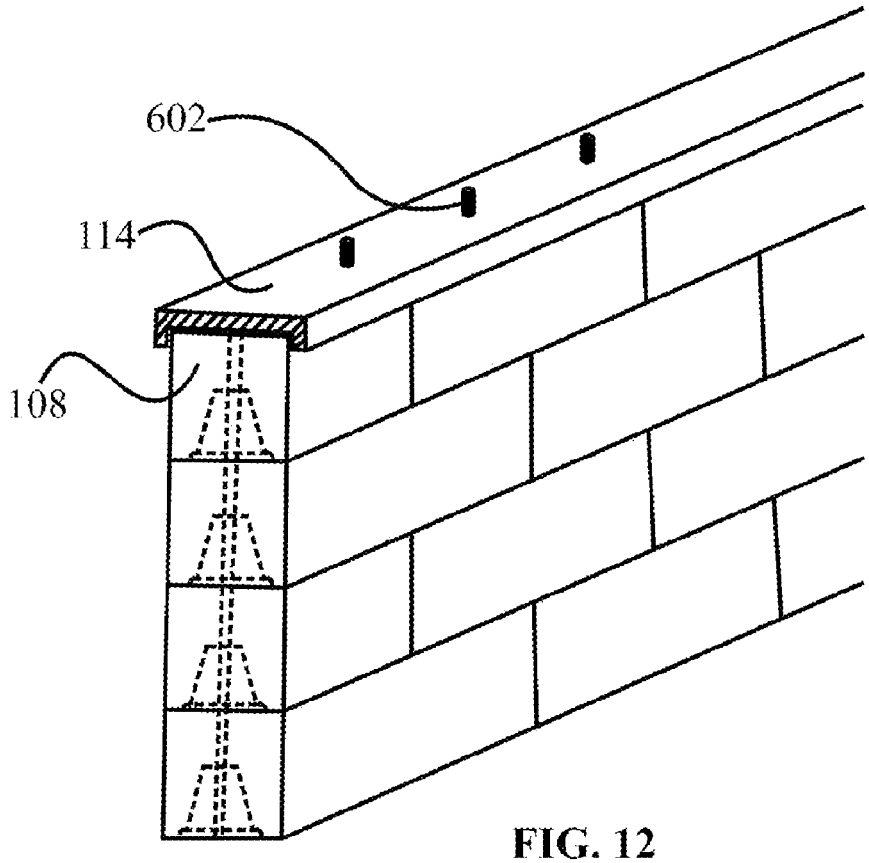
FIG. 12 illustrates a cross sectional view of the wall structure with the covering plate in the mortarless construction system according to one embodiment.

FIG. 12 illustrates a cross sectional view of the wall structure with the covering plate in the mortarless construction system according to one embodiment of the present invention. With respect to FIG. 12, the covering plate 114 is fixed on the flat surface of the plurality of wall units 108 on which a roof is supported in such a way that the threaded upper end sections 602 of the final tendon rods of a wall which are projected out of the flat surface of the plurality of wall units 108, pass through holes 906 in the covering plate 114 and projected out of the surface of the covering plate 114. The height of the tendon rods which are used to fix the final row wall units is different from the tendon rods used in the other wall units, because of the difference in the shape of the wall units 108 and the thickness of the covering plate 114. The threaded end sections 602 of the final tendon rods of the wall which are projected out of the surface of the covering plate 114 are attached to a plurality of roof connectors with the mechanical fastening means for constructing a slab roof or a floor.

Figure 13:
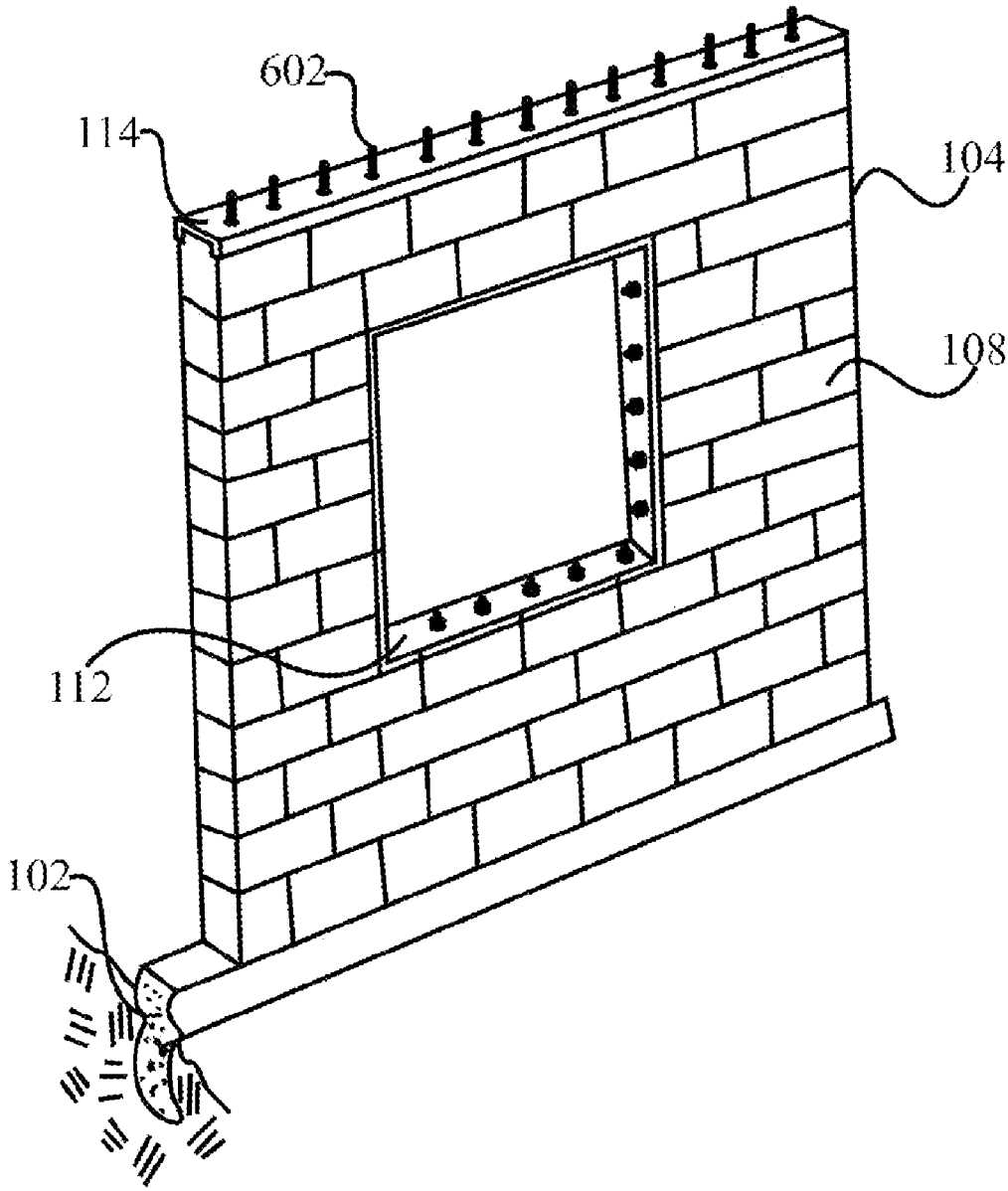
FIG. 13 illustrates a schematic view of the wall structure with the window frame in the mortarless construction system according to one embodiment.

FIG. 13 illustrates a schematic view of the wall structure with the window frame in the mortarless construction system according to one embodiment of the present invention. With respect to FIG. 13 the wall structure 104 of the mortarless construction system is erected on the wall foundation 102. The wall structure 104 includes the plurality of wall units 108 reinforced with the tendon rods and mechanical fastening means, the door and window frames 112 and the covering plate 114 on top of the wall structure 104. The doors and windows of the building are placed on the door and window frame 112 arranged in the wall structure. The door and window frame 112 is constructed with adequate strength so as to bear the weight of the rest of the building which is on the upper side of the frame. During the assembly process of the door and window, the door and window frame 112 cut a few of tendon rods in the wall structure. The door and window frame 112 is attached to the tendon rods passing through the internal cavities of adjacent wall units 108 of the wall structure 104. For attaching the top side of the frame 112, the lower threaded end sections of the plurality of tendon rods are inserted to the punches in the top side of the frame 112 and attached to the top side of the frame 112 using the mechanical fastening means. Then the pluralities of wall units 108 are stacked on these tendon rods to complete the wall structure 104. When the wall structure 104 is reaches the ceiling, a plurality of wall units 108 which include the flat top surface is placed on the final tendon rods of the wall structure 104 in such a way that the final tendon rods of the wall structure 104 are projected above the flat surface of the plurality of wall units 108. The covering plate 114 is fixed on the flat surface of the plurality of wall units 108 on which a roof is supported in such a way that the threaded upper end sections 602 of the final tendon rods of a wall which are projected out of the flat surface of the plurality of wall units, pass through holes in the covering plate 114 and projected out of the surface of the covering plate 114. The threaded end sections 602 of the final tendon rods of the wall which are projected out of the surface of the covering plate 114 are attached to a plurality of roof connectors with the mechanical fastening for constructing a slab roof or a floor.

Figure 14A:
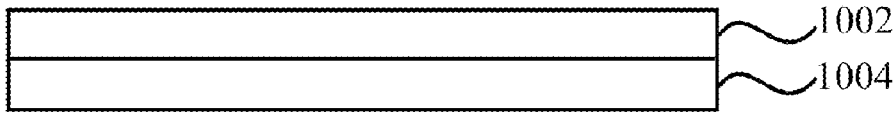
FIG. 14 illustrates a top view of a wall structure with a beam structure in a mortarless construction according to one embodiment.
Figure 14B:
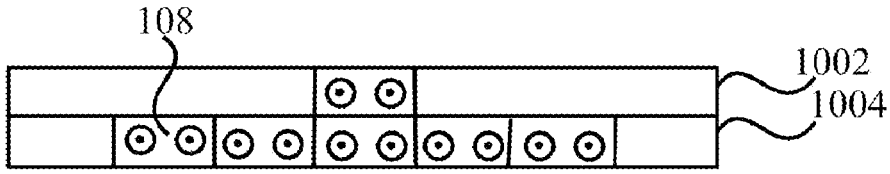

FIG. 14 illustrates a top view of a wall structure with a beam structure in a mortarless construction according to one embodiment of the present invention. With respect to FIG. 14A, the wall foundation is constructed in an inner row 1002 and an outer row 1004. The wall foundation for a beam structure is thicker than of normal wall foundation in the mortarless construction. With respect to FIG. 14B, the base wall foundation of the outer row 1004 includes a plurality of foundation tendon rods projecting above the surface of the base wall foundation and the base wall foundation in the inner row 1002 includes the plurality of foundation tendon rods in a preferred place 1006 of the inner row 1002 where a beam support wall is formed. The first set of mechanical fastening means is attached to the threaded end sections of the plurality of foundation tendon rods projecting out of the base wall foundation in the inner row 1002 and the outer row 1004. The first set of tendon rods having both threaded end sections is attached to the first set of mechanical fastening means. The plurality of wall units 108 is stacked in a series of row on the first set of tendon rods of the inner row 1002 and the outer row 1004. Upon arranging the plurality of wall units 108 on the first set of tendon rods, the second set of mechanical fastening means are attached to each threaded top end portion of the first set of tendon rods. Thus the plurality of wall units 108 arranged in the inner row 1002 and the outer row 1004 is fastened to the base wall foundation by screwing down the nut in the second set of mechanical fasteners.

With respect to FIG. 14B, once the plurality of wall units 108 are fastened to the wall foundation, the second set of tendon rods are attached to the nut in the second set of mechanical fasteners. Then a plurality of singular wall units 1008 which are in a square shape for both the inner row 1002 and the outer row 1004 is arranged horizontally onto the second set of tendon rods in the inner row 1002 and the outer row 1004. Another subsequent set of mechanical fastening means are attached to the top threaded end section of the second set of tendon rods. The plurality of single wall units 108 stacked on the second set of tendon rods are then fastened to the plurality of wall units 108 stacked on the first set of tendon rods.

Figure 14C:
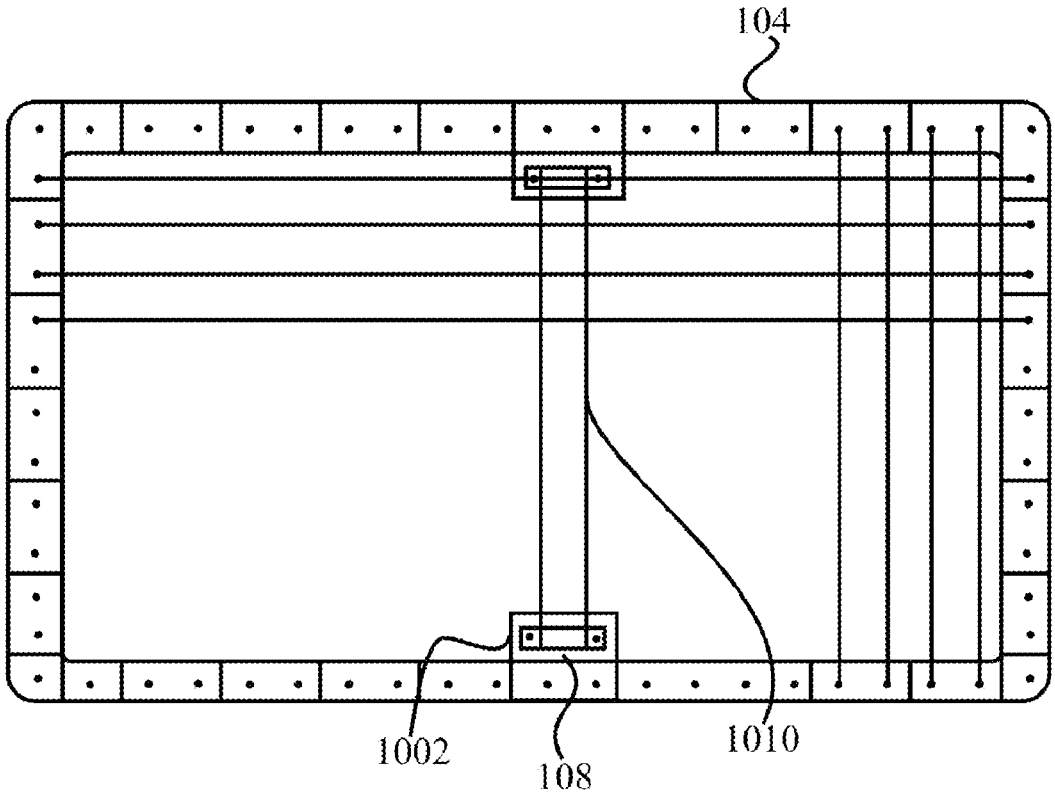

FIG. 14C illustrates a top view of a beam structure placed on the wall structures of a mortarless construction according to one embodiment of the present invention. With respect to FIG. 14C, the wall structure is built with the inner row 1002 and the outer row 1004 by vertically stacking the plurality of wall units 108 and the plurality of singular wall units consecutively onto the tendon rods and affixing the plurality of wall units using the mechanical fasteners to the underlying wall units.

Figure 15:
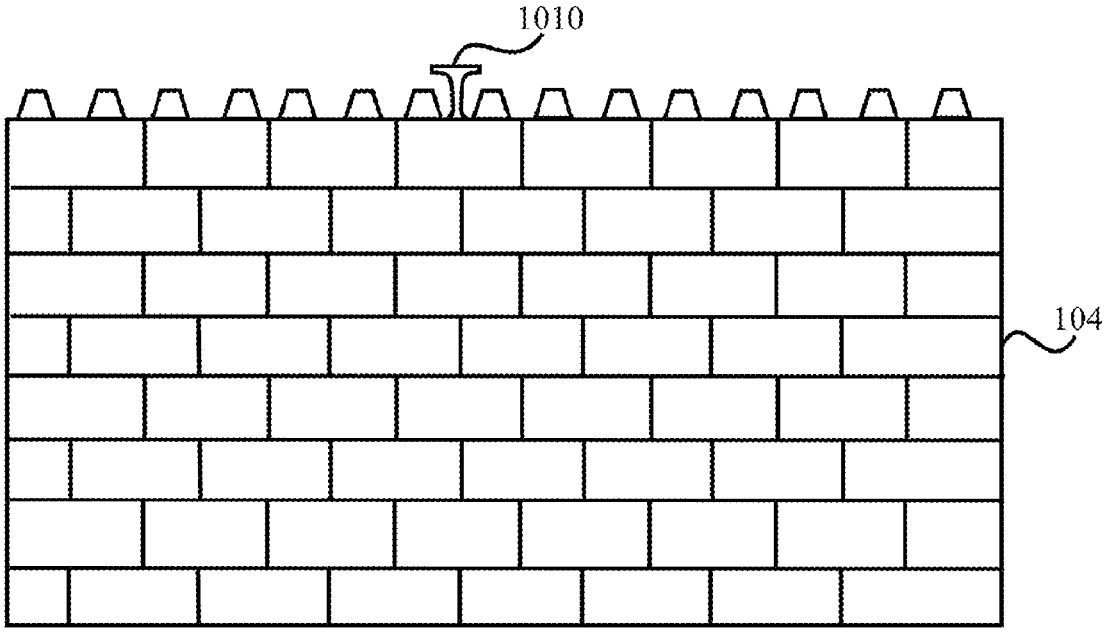
FIG. 15 illustrates a front view of a wall structure with the beam structure in a mortarless construction system according to one embodiment.

FIG. 15 illustrates a front view of a wall structure provided with a beam structure in a mortarless construction system according to one embodiment of the present invention. FIG. 15 illustrates a front view of a wall structure with the beam structure in a mortarless construction system according to one embodiment of the present invention. With respect to FIG. 15, when the wall structure 104 reaches up the ceiling, a support beam 1010 is placed on the wall units 108 having the flat top surface stacked in the inner row 1002 of two opponent wall structures 104. When the distance between the wall structures 104 is increased, the roof in the mortarless construction requires the support beam 1010 to bear the roof load.

Figure 16A:
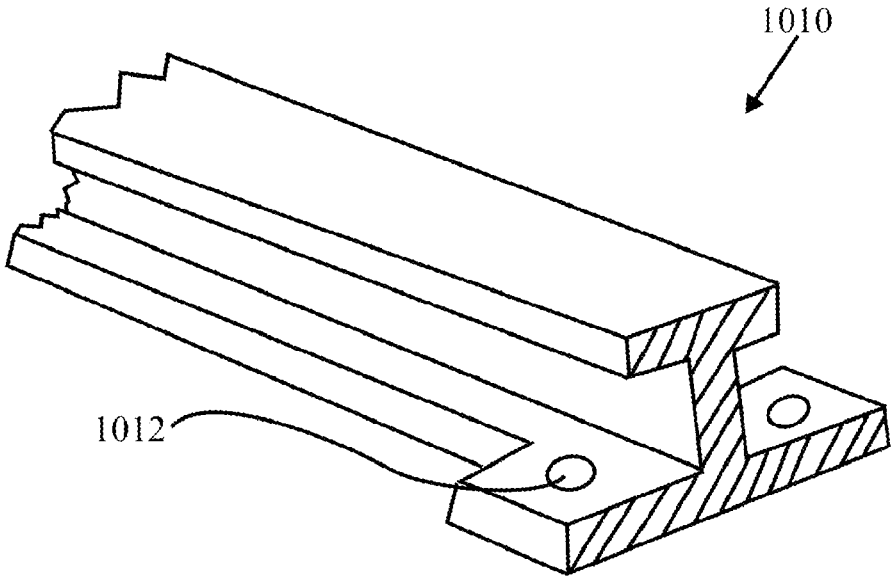
FIG. 16A illustrates a side perspective view of the beam structure for a roof in a mortarless construction system according to one embodiment.

FIG. 16A illustrates a side perspective view of the beam structure for a roof in a mortarless construction system according to one embodiment of the present invention. The support beam 1010 is an elongated structure arranged between two opponent wall structures. With respect to FIG. 16A, the support beam includes a top surface, which forms a part of the roof when built in. The support beam is arranged in such a manner that it is connected to the centre of at least one of the opponent wall. The end portions of the support beam 1010 is provided with holes 1012 to accommodate the tendon rods projecting out of the wall unit for fastening the support beam 1010 to the wall units. The top surface of the wall unit on which the support beam is fastened is flat so that no gap is created between the support beam and the wall structure.

Figure 16B:
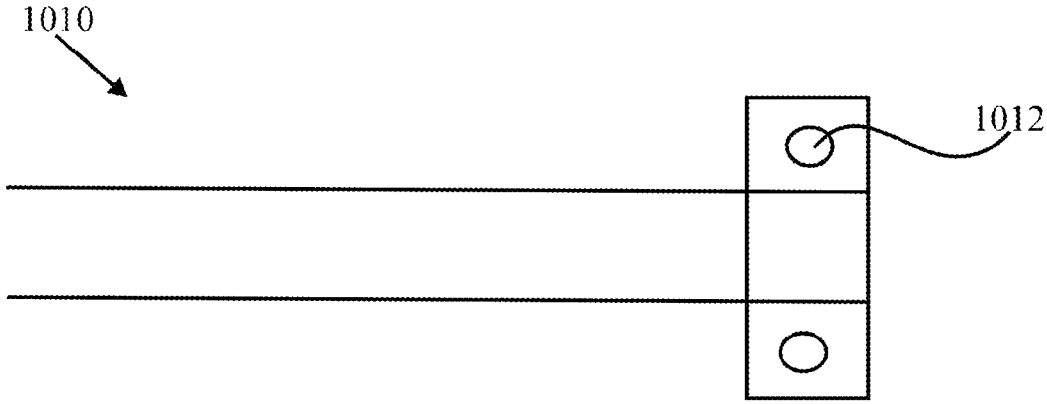
FIG. 16B illustrates a top view of the beam structure for the roof in the mortarless construction system according to one embodiment.

FIG. 16B illustrates a top view of the beam structure for the roof in the mortarless construction system according to one embodiment of the present invention. With respect to FIG. 16B, at least one section of the support beam 1010 is provided with a pair of holes 1012 to attach the support beam 1010 to the wall unit. The support beam 1010 herein is made up of materials like UHPC, iron, metal or any other composite material.

Figure 17A:
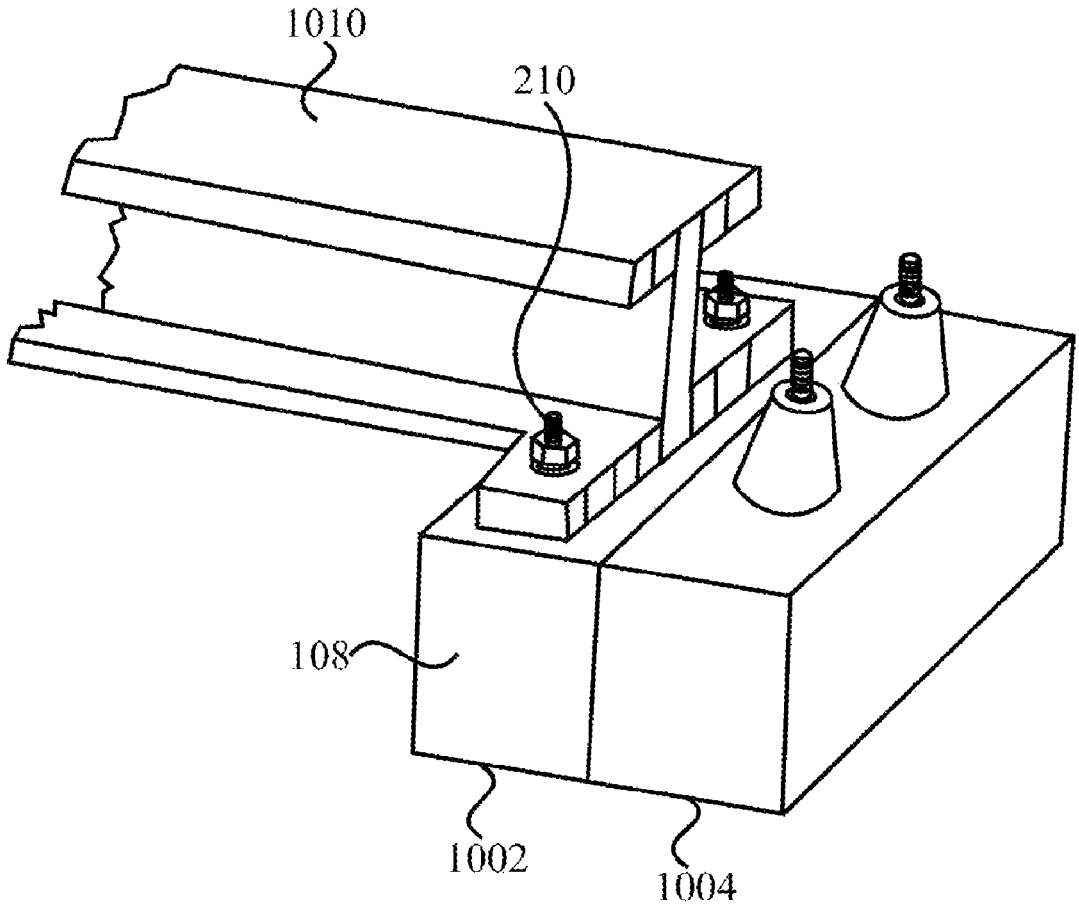
FIG. 17 illustrates the arrangement of the beam structure on the wall structure in the mortarless construction system according to one embodiment.
Figure 17B:
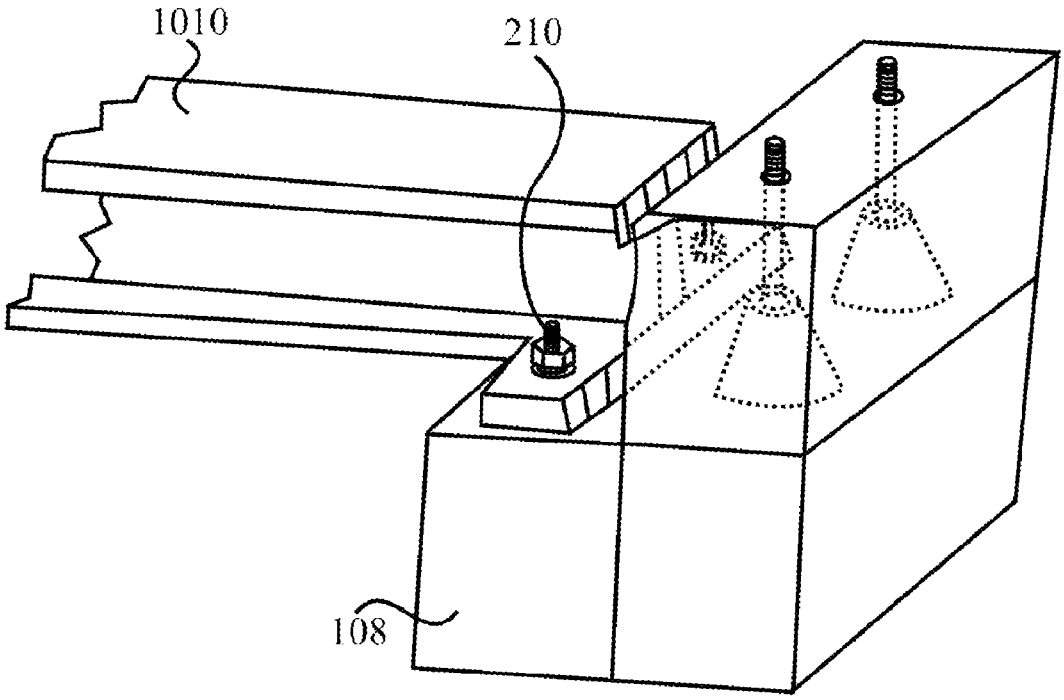

FIG. 17 illustrates the arrangement of the beam structure on the wall structure in the mortarless construction system according to one embodiment of the present invention. With respect to FIG. 17, the support beam 1010 is attached to the tendon rods 210 projected out of the flat surface of the wall unit 108 stacked in the inner row 1002. The wall unit 108 having the flat surface is stacked in the outer row 1004 to bring the height of the wall structure in the outer row 1004 equivalent to the level of the support beam 1010. The tendon rods projected out of the flat surface of the wall units 108 in the outer row 1004 are attached to the slab roof system of the mortarless construction system.

Figure 18:
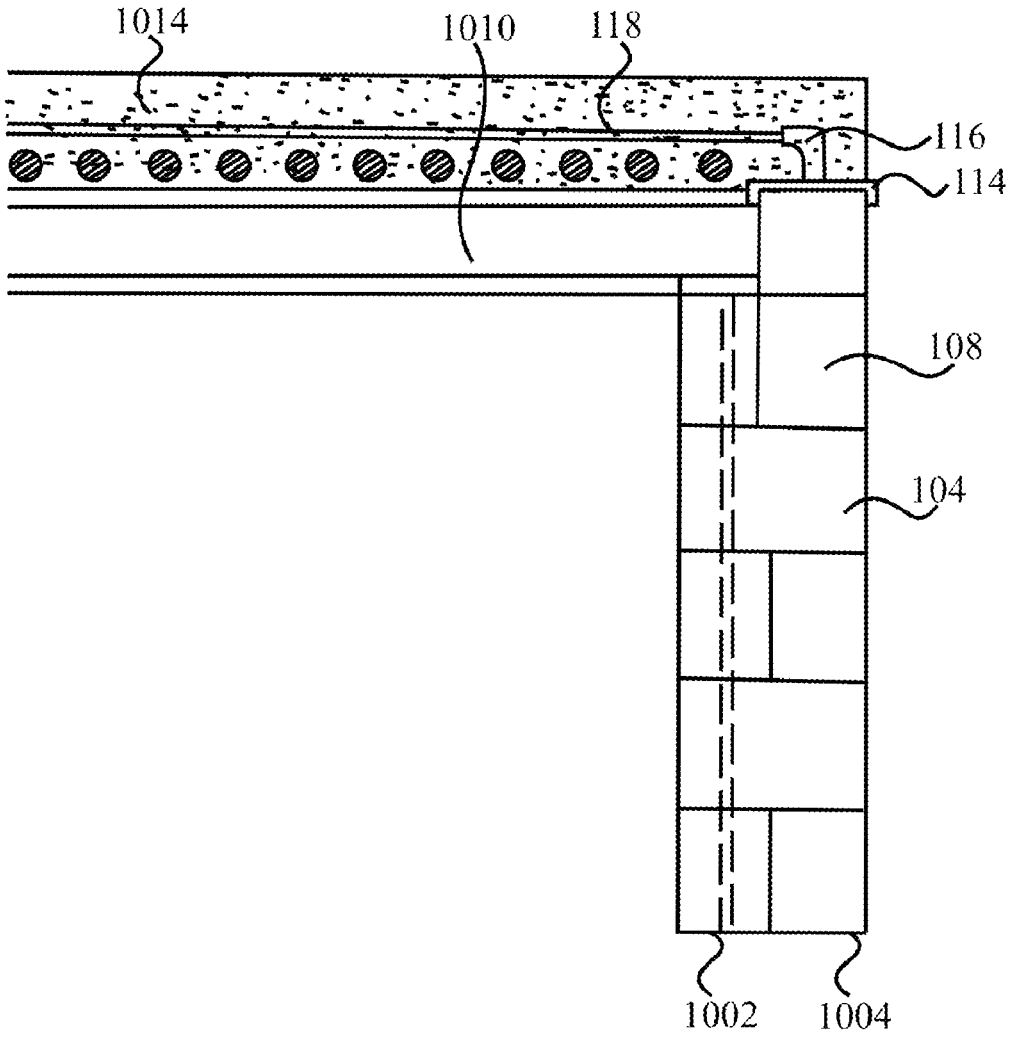
FIG. 18 illustrates a cross sectional view of a slab roof with the beam structure placed on the wall structure in the mortarless construction system according to one embodiment.

FIG. 18 illustrates a cross sectional view of a slab roof with the beam structure placed on the wall structure in the mortarless construction system according to one embodiment of the present invention. With respect to FIG. 18, the support beam 1010 is attached to the tendon rods projected out of the flat surface of the wall unit 108 stacked in the inner row 1002. In the outer row 1004 of the wall structure 104, the wall unit 108 having the flat surface is stacked to bring the height of the wall structure 104 in the outer row 1004 equivalent to the level of the support beam 1010. The covering plate 114 is fixed onto the flat surface of the wall units 108 stacked in the outer row 1004 in such a way that the threaded end sections of the tendon rods projected out of the surface of the wall units 108 stacked in the outer row 1004 is passed through the holes in the covering plate 114 and attached to the top surface of the covering plate 114. Then the plurality of roof connecters 116 are attached to the threaded end section of the tendon rods projected out of the surface of the covering plate 114. Further the plurality of roof rods 118 having threaded ends are horizontally attached to the roof connecters 116 of opponent walls in such a way that a cross network of roof rods 118 is formed over the wall structures 104 for building the roof above the support beam 1010. When a settable cementing material 1014 for the roof is poured on the cross networks of roof rods 118, the settable cementing material 1014 cures to form a concrete layer on the top of the support beam 1010.

Figure 19A:
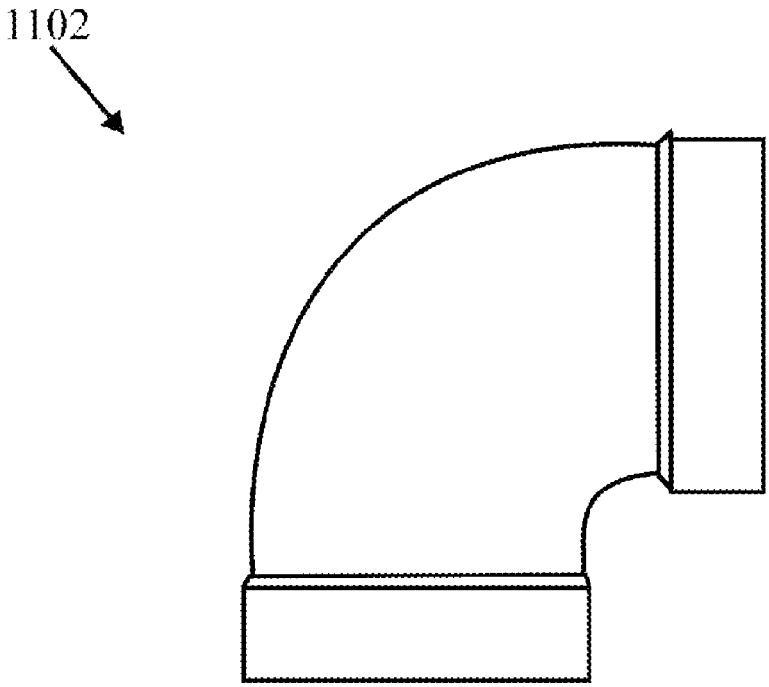
FIG. 19A illustrates a two way roof connector of a slab roof in a mortarless construction system according to one embodiment.

FIG. 19A illustrates a two way roof connector of a slab roof in a mortarless construction system according to one embodiment of the present invention. The roof connectors serve to connect the roof rods to the tendon rods projecting out of the wall units. The two way roof connector 1102 is an elbow shaped roof connector which has threaded end portions. The one end portion of the two way roof connector 1102 is connected to the tendon rods of the wall structure and another end portion of the two way roof connector 1102 is connected to the roof rods of the slab roof system. The two way roof connector 1102 is used for a single floor mortarless construction or the top most roof in the multi-storey mortarless construction.

Figure 19B:
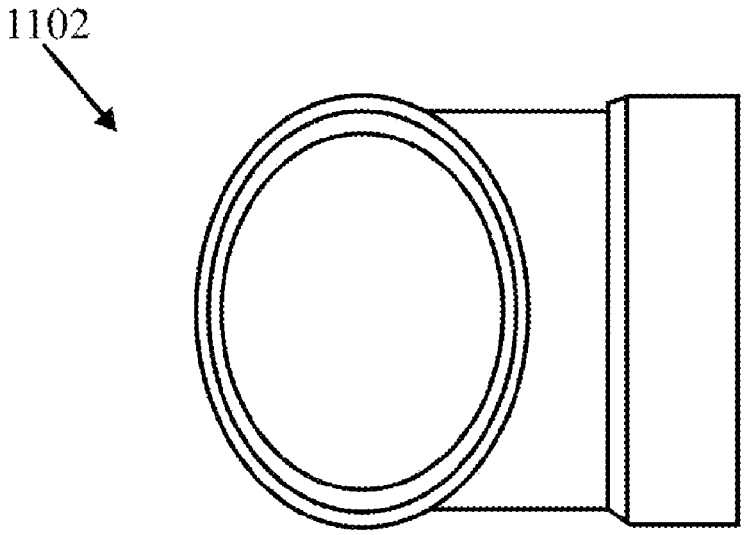
FIG. 19B illustrates a bottom view of the two way roof connector of the slab roof in the mortarless construction system according to one embodiment.

FIG. 19B illustrates a bottom view of the two way roof connector of the slab roof in the mortarless construction system according to one embodiment of the present invention. The end portion of the two way roof connector is provided with windings on the inner surface. The end portion engages with the threaded end sections of the tendon rods projecting from the wall units.

Figure 20A:
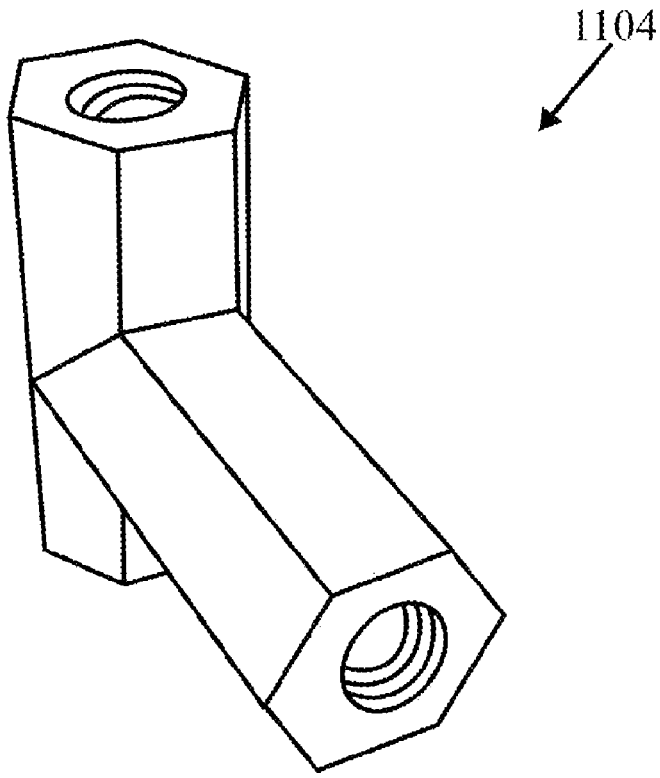
FIG. 20 side perspective view of various multiple way roof connectors in a mortarless construction system according to one embodiment.

FIG. 20 illustrates side perspective view of multiple way roof connectors in a mortarless construction system according to one embodiment of the present invention. With respect to FIG. 20A, a three way roof connector is provided. The three way roof connector 1104 is used for connecting the roof to the side walls for the middle floor in a few storey mortarless constructions.

Figure 20B:
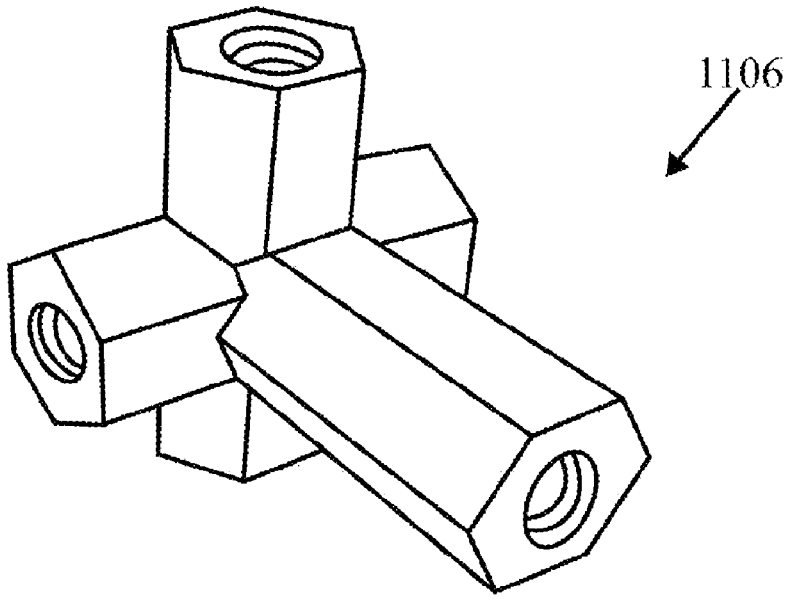

FIG. 20B illustrates a five way roof connector for use in a mortarless construction. The five way roof connector 1106 is used for connecting the walls to the roof/floor in case of multi-storey building. The five way roof connector 1106 engages with the tendon rods projecting out of the side walls defining different rooms. The roof connectors are made of metal or any other suitable material capable of providing substantial strength.

Figure 21:
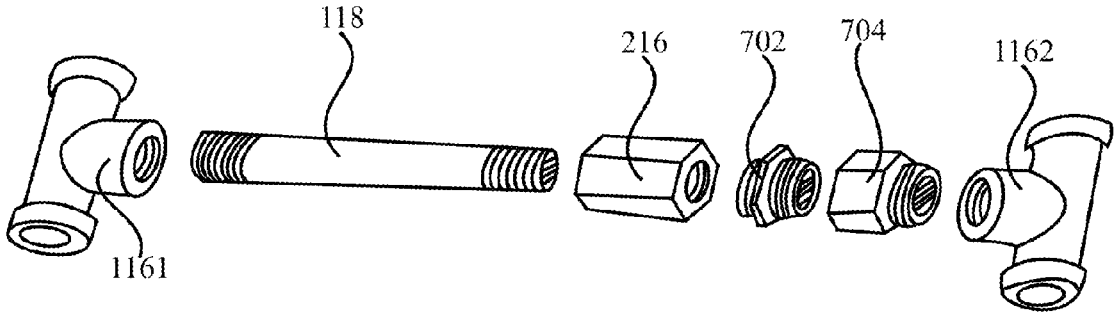
FIG. 21 illustrates an exploded view of a roof connector connected to a roof rod of a slab roof in a mortarless construction system according to one embodiment.

FIG. 21 illustrates an exploded view of a roof connector connected to a roof rod of a slab roof in a mortarless construction system according to one embodiment of the present invention. With respect to FIG. 21, the plurality of roof rods 118 having both threaded end sections is attached in between the horizontal end of the roof connectors 1161 and the coupling nut 216 which is attached to the pipe union 702 and then to the bell reducer 704 to form an adequate tension in the roof rods 118. The bell reducer 704 is attached to the corresponding roof connector 1162 of the opponent walls. The roof rods 118 are metallic or any other fiber resistant polymer material. The horizontal crossed roof rods 118 are connected together in the cross section with a soft wire. Thus a network of roof rods 118 interconnecting the walls is formed for building the roof.

Figure 22:
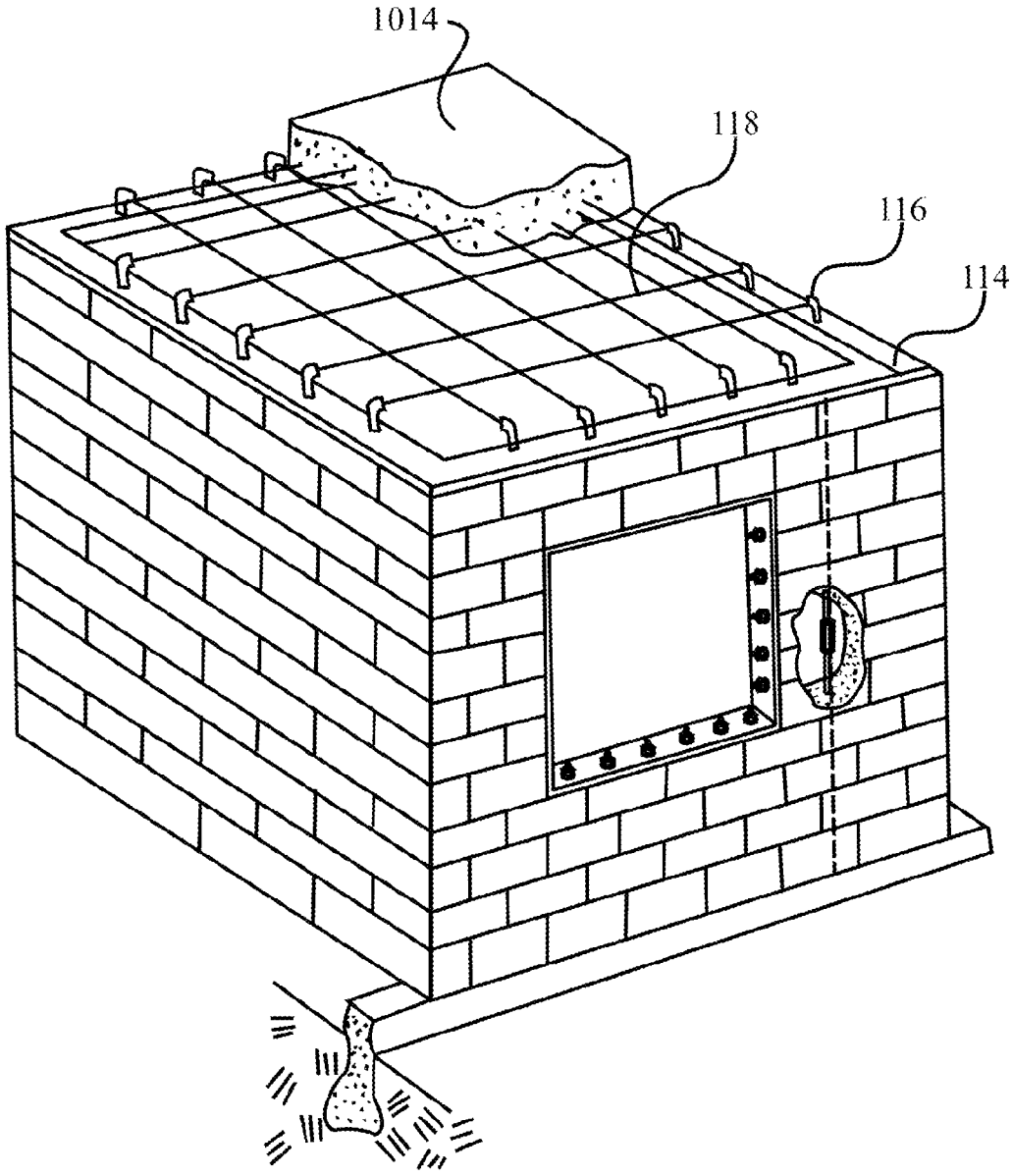
FIG. 22 illustrates a perspective view of a slab roof for a mortarless masonry construction system according to one embodiment.

FIG. 22 illustrates a perspective view of a slab roof for a mortarless masonry construction system according to one embodiment of the present invention. With respect to FIG. 22, a plurality of rood rods 118 are provided which forms a network of roof rods 118 interconnecting the wall structures is formed for building the roof, metal sheets are placed temporary underneath the roof rods 118 and a layer of the settable cementing material 1014 such as UHPC material is poured onto the roof rods 118. The settable cementing material 1014 is allowed to set to form a concrete layer. The concrete layer covers the surface of the covering plate 114. The skeleton of roof rods 118 and the roof connectors 116 which are located inside the poured concrete provides for the strength of the roof in the mortarless construction system.

The various embodiments of the present invention provide a slab roof for interlocked mortarless masonry wall systems. The mortarless construction system herein does not require any skilled crew to construct the structure. The mortarless construction system does not require elaborate bracing process. The mortarless construction system provides immediate use after completion of the construction. The wall units used in the mortarless construction system have consistent and accurate dimensions, which provides for a wall structure with expert finishing.

The wall units herein are easily removable after removing the roof from the wall structure thereby serving the purpose of re-usability. The mortarless construction system reduces the time to build or rebuild constructions with minimal skilled labor. The mortarless construction system provides a superior and more consistent strength structure than the traditional mortar constructed structure and other interlocking and mortarless building systems, because the roof reinforcements in the mortarless construction system are directly attached to the wall reinforcement elements and the provides an integral, monolithic and flexible building system.

The mortarless construction system is built with simple tools and does not require any mortar between the wall units to provide interconnectivity between the wall units. The construction system is anti-seismic because of the mechanical interconnection between the building components such as wall units, wall reinforcements, roof reinforcements, windows and door frames. The mortarless construction system provides a construction system using a combination of preformed members and cast in situ material that is cost effective for residential and commercial projects and that does not require a large amount of specialized erection equipment. The mortarless construction system provides a building block construction and reinforcing structure which has less weight for a given strength, improved heat and sound insulating qualities, minimum cost, maximum utility and flexibility of design.

The light weight and load bearing characteristics of the wall units of the mortarless construction system and greater proportional strength of the structure are suitable for constructing multi-story buildings where the weight of the structure forms the principal load to be carried. It is readily understood that a slight reduction in weight of a floor or roof construction in such buildings materially reduce the size and weight of the supporting walls required. The mortarless construction system uses the UHPC material in place of the ordinary concrete. The compressive strength of the UHPC is more than 160 Mega Pascal which is four times the strength of ordinary concrete. The mortarless construction system generates very little debris. The inherent stability of the structures created with the present mortarless construction system eliminates the need for a welded superstructure. The embodiment herein also eliminates the need for specialized labor force and specialized inspection as required for other construction systems.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A method of providing a mortarless construction, the method comprising steps of:

providing a wall foundation structure including a plurality of foundation tendon rods having at least one threaded end section;

building the wall foundation by pouring a concrete material to the wall foundation structure such that the at least one threaded end section of the plurality of foundation tendon rods projects above a surface of the wall foundation;

providing a first set of mechanical fastening means to each threaded end section of the plurality of foundation tendon rods projecting out of the wall foundation;

attaching a first set of threaded tendon rods to the first set of mechanical fastening means;

arranging a plurality of wall units in a horizontal row on the first set of threaded tendon rods, wherein the first set of threaded tendon rods pass through the plurality of wall units such that each threaded end portion of the first set of threaded tendon rods is projected out of a top surface of the plurality of wall units;

providing a second set of mechanical fastening means to each threaded end portion of the first set of threaded tendon rods passed through a channel of the plurality of wall units, thereby fastening the plurality of wall units to the wall foundation;

creating a wall structure by vertically stacking the plurality of wall units onto the threaded tendon rods and affixing a plurality of masonry blocks using a subsequent set of mechanical fastening means, wherein the plurality of wall units are interconnected by attaching the threaded end section of the threaded tendon rods to the subsequent set of mechanical fastening means;

providing a covering plate onto a flat surface of the plurality of wall units on which a roof is supported, wherein the covering plate is fixed to the threaded tendon rods projected out of the plurality of wall units;

attaching a plurality of roof connecters to the at least one threaded end section of the threaded tendon rods projected out of a surface of the covering plate;

attaching a plurality of roof rods having threaded end sections to the roof connecters of opponent walls thereby forming a network of roof rods interconnecting the walls for building a roof, wherein the roof rods are attached to the threaded tendon rods through the roof connecters; and providing a beam structure for said roof in said mortarless construction, wherein said providing a beam structure comprising steps of:

building a wall foundation having an inner row and an outer row, wherein the wall foundation in the outer row includes a plurality of foundation tendon rods projecting above a surface of the wall foundation and the wall foundation in the inner row includes a plurality of foundation tendon rods in the inner row;

providing the first set of mechanical fastening means to a threaded end portion of the plurality of foundation tendon rods projecting out of the wall foundation in the inner and outer rows;

attaching a first set of threaded tendon rods to the first set of mechanical fastening means;

stacking a plurality of wall units on the first set of threaded tendon rods of the inner and outer rows thereby the first set of threaded tendon rods passing through the plurality of wall units and a portion of the first set of threaded tendon rods projecting out of top surfaces of the plurality of masonry blocks of the inner and outer rows, wherein each wall unit includes at least one channel for the passage of the threaded tendon rod;

providing the second set of mechanical fastening means to a threaded end portion of the first set of threaded tendon rods passed through the channel of the plurality of wall units of the inner and outer rows, thereby fastening the plurality of wall units to the wall foundation in the inner and outer rows;

creating a wall structure by stacking the plurality of wall units on the threaded tendon rods of the inner and outer rows and affixing the plurality of wall units using a subsequent set of mechanical fastening means, wherein the plurality of rows of the wall units are interconnected by attaching the threaded end section of the threaded tendon rods to the subsequent set of mechanical fastening means;

providing a support beam having ends placed on the wall units stacked in the inner row of two opponent walls, wherein the support beam is placed underneath of a roof;

attaching the support beam to the threaded tendon rods projected out of the surface of the wall unit stacked in the inner row; and providing a covering plate onto the wall units stacked in the outer row, wherein the covering plate is fixed to the threaded tendon rods projected out of a surface of the wall units stacked in the outer row such that the threaded end sections of the threaded tendon rods are projected out of a surface of the covering plate;

attaching a plurality of roof connecters to the threaded end section of the threaded tendon rods projected out of the surface of the covering plate; and attaching a plurality of roof rods having threaded ends to the roof connecters of the opponent walls thereby forming a cross network of roof rods over the walls for building the roof above the support beam, wherein the roof rods are attached to the threaded tendon rods through the roof connecters.

2. The method of claim 1, further comprising:

building a roof structure by pouring a concrete material to the network of roof rods.

3. The method of claim 1, wherein the step of creating a wall structure by stacking the plurality of wall units onto the threaded tendon rods and affixing the plurality of wall units using the subsequent set of mechanical fastening means, further comprising steps of:

attaching a second set of threaded tendon rods to a second set of mechanical fastening means;

stacking the plurality of wall units in a row onto the second set of threaded tendon rods thereby the second set of threaded tendon rods passing through the plurality of wall units and a portion of the second set of threaded tendon rods projecting out of top surfaces of the plurality of masonry blocks; and providing subsequent set of mechanical fastening means to a threaded end portion of the second set of threaded tendon rods passed through the channel of the wall units, thereby fastening the plurality of wall units stacked on the second set of threaded tendon rods to the plurality of wall units stacked on the first set of threaded tendon rods.

4. The method of claim 1, further comprising steps of:

providing a frame including a plurality of holes, wherein a distance between each of the plurality of holes is equal to a length of the vertical cavity provided in the wall unit;

attaching bottom side of the frame to the threaded tendon rods projecting out of the wall units;

attaching top side of the frame to the threaded tendon rods on which the plurality of wall units are to be stacked; and attaching vertical sides of the frame to adjacent threaded tendon rods projected out of the plurality of wall units through a connecting bar.

5. The method of claim 1, wherein the plurality of wall units engaged with the roof includes a flat top surface.

6. The method of claim 1, wherein the roof connecter includes at least one of a pipe union, bell reducer and a washer to provide substantial tension to the roof rods.

7. The method of claim 1, wherein the threaded tendon rods, the first set of mechanical fastening means, the second set of mechanical fastening means and the subsequent set of mechanical fastening means, the roof connecters and roof rods are made up of at least one of a composite material.

* * * * *